US009085183B2

(12) United States Patent
Terada

(10) Patent No.: US 9,085,183 B2
(45) Date of Patent: Jul. 21, 2015

(54) LIQUID EJECTION APPARATUS, PATTERN GROUP RECORDING METHOD, TILT ANGLE DETECTION METHOD AND COMPUTER READABLE MEDIUM

(71) Applicant: Kohei Terada, Kiyosu (JP)

(72) Inventor: Kohei Terada, Kiyosu (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 0 days.

(21) Appl. No.: 14/496,089

(22) Filed: Sep. 25, 2014

(65) Prior Publication Data

US 2015/0091958 A1 Apr. 2, 2015

(30) Foreign Application Priority Data

Sep. 30, 2013 (JP) ..... 2013-204285

(51) Int. Cl.

| | |
|---|---|
| ***B41J 29/393*** | (2006.01) |
| ***B41J 25/00*** | (2006.01) |
| ***B41J 2/13*** | (2006.01) |
| ***B41J 2/045*** | (2006.01) |
| ***B41J 2/21*** | (2006.01) |

(52) U.S. Cl.

CPC ..... *B41J 25/00* (2013.01); *B41J 2/04506* (2013.01); *B41J 2/04558* (2013.01); *B41J 2/13* (2013.01); *B41J 2/2135* (2013.01); *B41J 2/2146* (2013.01); *B41J 25/003* (2013.01); *B41J 2029/3935* (2013.01)

(58) Field of Classification Search

CPC ..... B41J 25/00; B41J 2/2135; B41J 2/2146; B41J 2/04506; B41J 2/04558; B41J 2/13; B41J 25/003; B41J 2029/3935

See application file for complete search history.

(56) References Cited

U.S. PATENT DOCUMENTS

2005/0062784 A1 3/2005 Matsuzaki et al.

FOREIGN PATENT DOCUMENTS

| | | | |
|---|---|---|---|
| JP | H08-90837 | 4/1996 | |
| JP | 2001-286812 | 10/2001 | |
| JP | 2001-286813 | 10/2001 | |
| JP | 2005-053167 | 3/2005 | |
| JP | 2009137015 | * 6/2009 | ..... B41J 29/393 |
| JP | 2010-042565 | 2/2010 | |
| JP | 2010-042596 | 2/2010 | |

* cited by examiner

*Primary Examiner* — Julian Huffman

(74) *Attorney, Agent, or Firm* — Frommer Lawrence & Haug LLP

(57) ABSTRACT

Each of unit patterns includes: a first region which is recorded on a recording medium by liquid ejected from ejection openings of both first and second ejection opening arrays of ejection opening arrays; and at least one second region which is recorded on the recording medium by liquid ejected from the ejection openings of one of the first and the second ejection opening arrays, the first region is a region formed based on dot allocation with which an optical characteristic varies in accordance with intervals of dots formed by the impacted liquid in a fourth direction which is orthogonal to a first direction, and the at least one second region is a region formed based on dot allocation with which the optical characteristic varies in accordance with intervals of the dots formed by the impacted liquid in the first direction.

15 Claims, 12 Drawing Sheets

LIQUID EJECTION APPARATUS, PATTERN GROUP RECORDING METHOD, TILT ANGLE DETECTION METHOD AND COMPUTER READABLE MEDIUM

CROSS REFERENCE TO RELATED APPLICATION

The present application claims priority from Japanese Patent Application No. 2013-204285, which was filed on Sep. 30, 2013, the disclosure of which is herein incorporated by reference in its entirety.

BACKGROUND OF THE INVENTION

1. Field of the Invention

The present invention relates to a liquid ejection apparatus, a pattern group recording method, a tilt angle detection method, and a computer readable medium.

2. Description of Related Art

A line-type inkjet printer (liquid ejection apparatus) having a head on which ejection openings are formed across the entire width of a recording medium has been known. In such an inkjet printer, to precisely eject ink onto a target position on the recording medium, it is necessary to, for example, line up the ejection openings on the head to be precisely orthogonal to the conveyance direction of the recording medium.

SUMMARY OF THE INVENTION

An object of the present invention is to provide a liquid ejection apparatus, pattern group recording method, tilt angle detection method, and a computer readable medium, which make it possible to easily detect an inclination of a liquid ejection head with respect to the conveyance direction of a recording medium.

According to the first aspect of the present invention, a liquid ejection apparatus includes: a conveyor configured to convey a recording medium in a first direction; a liquid ejection head in which ejection opening arrays, in each of which ejection openings for ejecting liquid are lined up in a second direction intersecting with the first direction, are lined up in a third direction orthogonal to the second direction; and a controller configured to control the conveyor and the liquid ejection head to record, onto the recording medium, a pattern group including unit patterns for detecting a tilt angle in the second direction with respect to the first direction, each of the unit patterns including: a first region which is recorded on the recording medium by liquid ejected from the ejection openings of both a first ejection opening array and a second ejection opening array of the ejection opening arrays; and at least one second region which is recorded on the recording medium by liquid ejected from the ejection openings of one of the first ejection opening array and the second ejection opening array, the first region being a region recorded based on dot allocation with which an optical characteristic varies in accordance with intervals of dots formed by the impacted liquid in a fourth direction which is orthogonal to the first direction, the at least one second region being a region recorded based on dot allocation with which the optical characteristic varies in accordance with intervals of the dots formed by the impacted liquid in the first direction, and between the unit patterns of the pattern group, the first regions being identical with one another in the dot allocation, and the second regions being different from one another in the dot allocation.

According to the second aspect of the present invention, a pattern group recording method for a liquid ejection apparatus includes a conveyor configured to convey a recording medium in a first direction and a liquid ejection head in which ejection opening arrays, in each of which ejection openings for ejecting liquid are lined up in a second direction intersecting with the first direction, are lined up in a third direction orthogonal to the second direction, by which method a pattern group including unit patterns for detecting a tilt angle in the second direction with respect to the first direction is recorded onto the recording medium, the method including the step of controlling the conveyor and the liquid ejection head to record, onto the recording medium, the pattern group including the unit patterns, each of the unit patterns including: a first region which is recorded on the recording medium by liquid ejected from the ejection openings of both a first ejection opening array and a second ejection opening array of the ejection opening arrays; and at least one second region which is recorded on the recording medium by liquid ejected from the ejection openings of one of the first ejection opening array and the second ejection opening array, the first region being a region formed based on dot allocation with which an optical characteristic varies in accordance with intervals of dots formed by the impacted liquid in a fourth direction which is orthogonal to the first direction, the at least one second region being a region formed based on dot allocation with which the optical characteristic varies in accordance with intervals of the dots formed by the impacted liquid in the first direction, and between the unit patterns of the pattern group, the first regions being identical with one another in the dot allocation, and the second regions being different from one another in the dot allocation.

According to the third aspect of the present invention, a tilt angle detection method includes the steps of: (i) selecting, from the unit patterns of the pattern group recorded onto the recording medium based on the method above, a unit pattern in which the optical characteristic of the at least one second region is closest to the optical characteristic of the first region; and (ii) calculating the tilt angle in the second direction with respect to the first direction, based on the optical characteristic of the unit pattern selected in the step (i).

According to the fourth aspect of the present invention, a non-transitory computer readable medium storing a program executed by a liquid ejection apparatus includes a conveyor configured to convey a recording medium in a first direction and a liquid ejection head in which ejection opening arrays, in each of which ejection openings for ejecting liquid are lined up in a second direction intersecting with the first direction, are lined up in a third direction orthogonal to the second direction, the program causing the liquid ejection apparatus to execute the step of controlling the conveyor and the liquid ejection head to record, onto the recording medium, the pattern group including the unit patterns, each of the unit patterns including: a first region which is recorded on the recording medium by liquid ejected from the ejection openings of both a first ejection opening array and a second ejection opening array of the ejection opening arrays; and at least one second region which is recorded on the recording medium by liquid ejected from the ejection openings of one of the first ejection opening array and the second ejection opening array, the first region being a region formed based on dot allocation with which an optical characteristic varies in accordance with intervals of dots formed by the impacted liquid in a fourth direction which is orthogonal to the first direction, the at least one second region being a region formed based on dot allocation with which the optical characteristic varies in accordance with intervals of the dots formed by the impacted liquid in the first direction, and between the unit patterns of the pattern group, the first regions being identical with one another in the dot allocation, and the second regions being different from one another in the dot allocation.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferable embodiment of the present invention with reference to the attached drawings.

Figure 1:
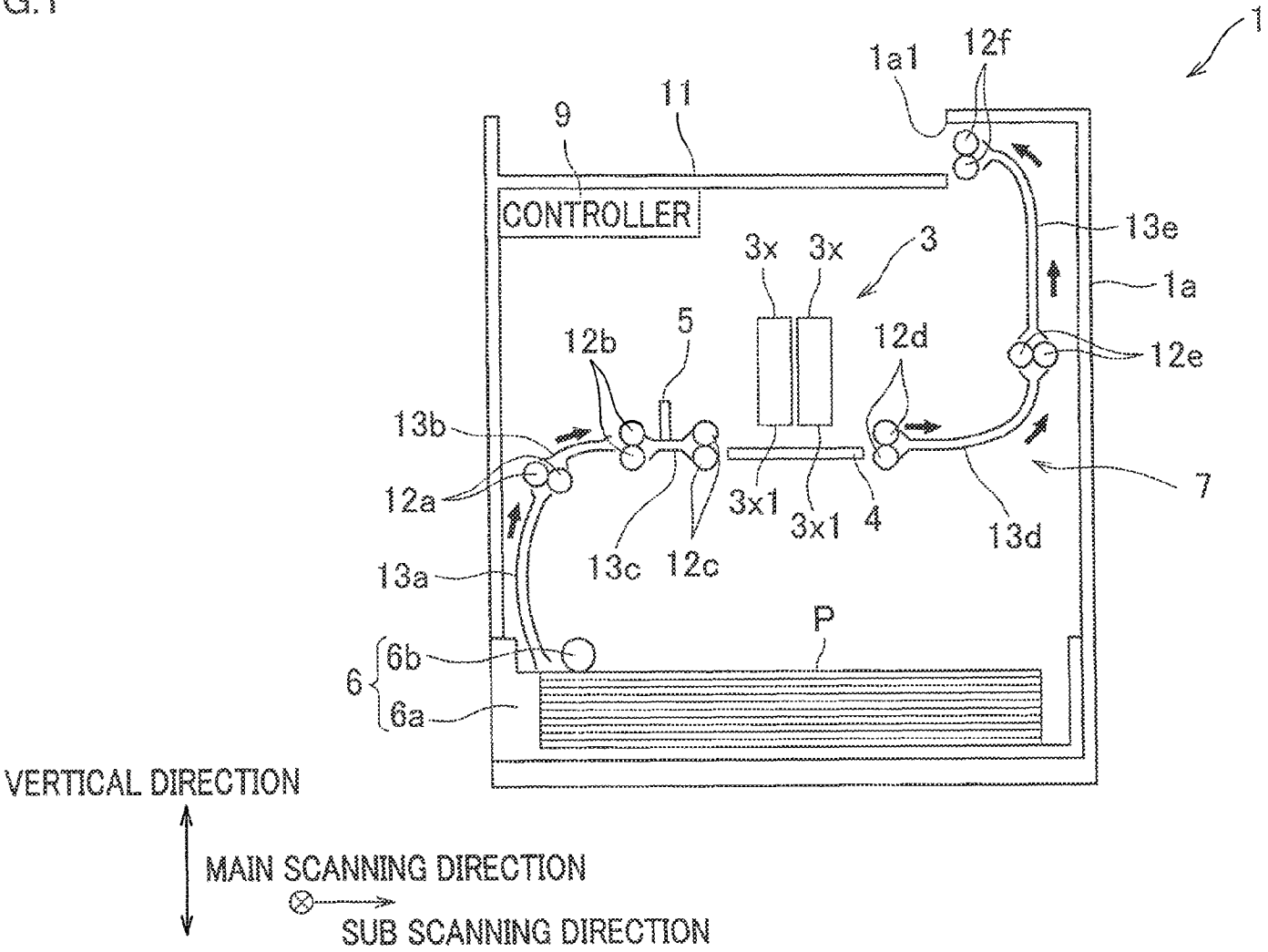
FIG. 1 is a schematic profile showing the internal structure of an inkjet printer related to an embodiment of the present invention.

First, with reference to FIG. 1, an overall structure of an inkjet printer 1 related to one embodiment of the present invention is described.

The printer 1 includes a casing 1*a* having a rectangular parallelepiped shape. In a top part of the top plate of the casing 1*a* is provided a sheet output unit 11. The casing 1*a* accommodates therein an inkjet head 3, a platen 4, a sheet sensor 5, a sheet-feeder unit 6, a conveyance unit 7, a scanner 8 (see FIG. 4), a touch panel 40 (see FIG. 4), a controller 9, and the like. Further, in the inside space of the casing 1*a*, there is a conveyance path through which a sheet P is conveyed from the sheet-feeder unit 6 to the sheet output unit 11 in a direction indicated by the bold arrow of FIG. 1.

Figure 2:
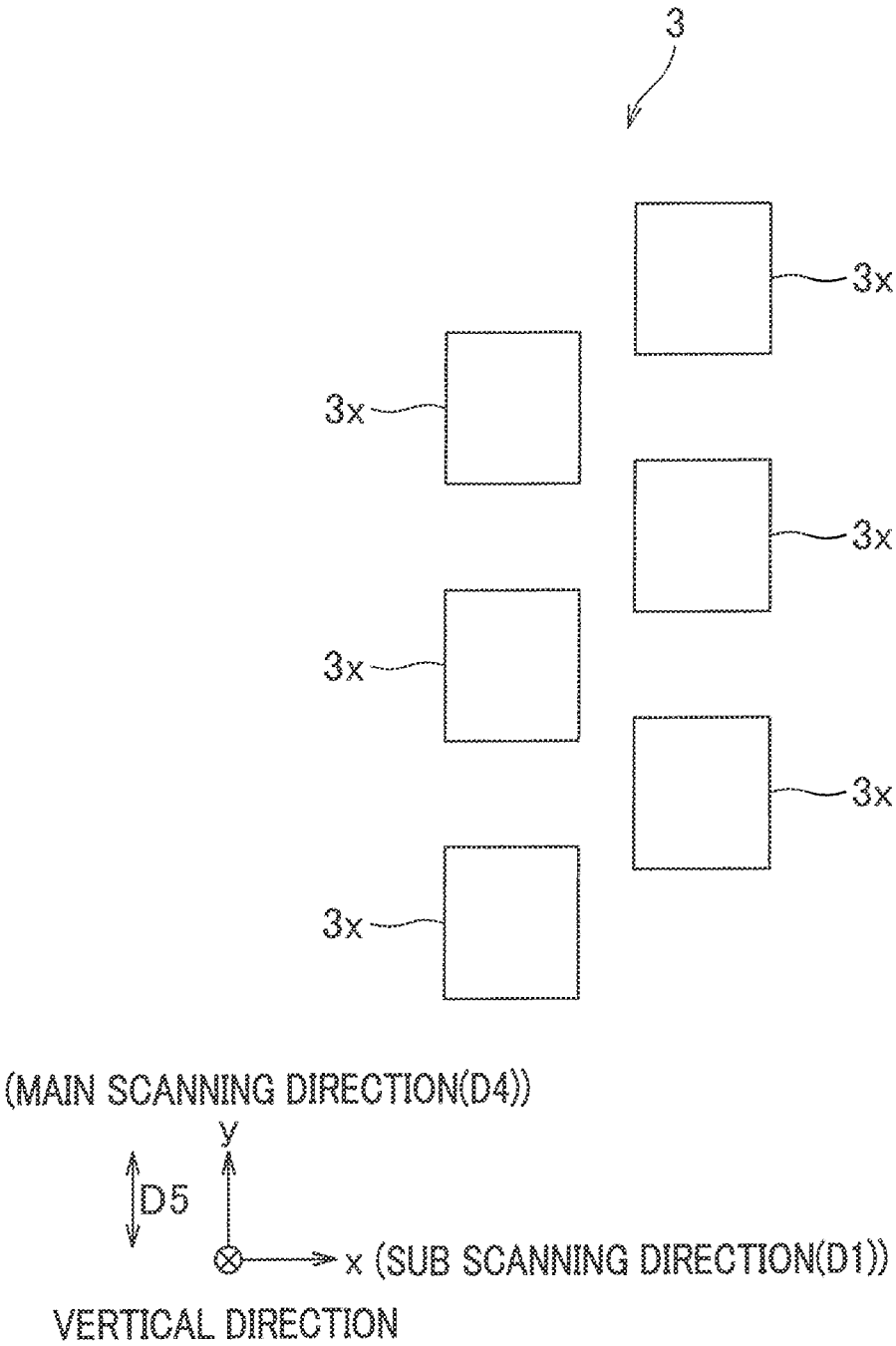
FIG. 2 is a plan view showing a structure of an inkjet head of the printer shown in FIG. 1.

The head 3 includes six head units 3*x* which are examples of the recording units of the present invention. The head units 3*x* are apart from each other and aligned in a main scanning direction, in a zigzag manner (see FIG. 2). The direction in which the head units 3*x* are arranged (fifth direction D5) intersects with the first direction D1 (sub scanning direction) which is in parallel to the opposing faces 3*x*1 (opposing the sheet P in the recording, see FIG. 1) of the head units 3*x* and is a relative moving direction of the head units 3*x* and the sheet P in the recording. In the present embodiment, the fifth direction D5 is the main scanning direction (which is in parallel to the opposing faces 3*x*1 and orthogonal to the first direction D1, i.e., is the fourth direction D4). The printer 1 is a line type printer which performs recording while its head units 3*x* are fixed. The six head units 3*x* each has the same structure, and includes a passage member, an energy applier, and a driver IC 47 (see FIG. 4). In the passage member are formed passages leading to ejection openings 30 (see FIG. 3A and FIG. 3B). The energy applier is configured to apply, to the ink inside the passages, energy for ejection of the ink from the ejection openings 30. The present embodiment adopts a piezoelectric energy applier (piezoelectric actuator) using a piezoelectric element. The piezoelectric actuator is connected to the controller 9 via a wiring member (e.g., flexible printed circuit board: FPC) having a driver IC 47 mounted thereon. Under control of the controller 9, a predetermined electric potential is given from the driver IC 47 to drive the piezoelectric actuator.

The platen 4 is a member in the form of a flat plate. The platen 4 faces the six head units 3*x* in the vertical direction. The vertical direction is perpendicularly crossing the main scanning direction and the sub scanning direction. Between the top surface of the platen 4 and the opposing face 3*x*1 of each of the head units 3*x* is a predetermined gap suitable for recording (image formation).

The sheet sensor 5 is disposed upstream of the head 3, relative to a direction of conveying the sheet P by the conveyance unit 7 (hereinafter, simply referred to as "conveyance direction"). The sheet sensor 5 detects the leading end of the sheet P and transmits a detection signal to the controller 9.

The sheet-feeder unit 6 includes a sheet-feeder tray 6*a* and a sheet-feeding roller 6*b*. The sheet-feeder tray 6*a* is detachable with respect to the casing 1*a*. The sheet-feeder tray 6*a* is an open-top box and is capable of accommodating a plurality of sheets P. In the present embodiment, the sheets P are blank white sheets. Driving the sheet-feeding motor 6M (see FIG. 4) under control of the controller 9 rotates the sheet-feeding roller 6*b*, thus feeding the uppermost one of the sheets P from the sheet-feeder tray 6*a*.

The conveyance unit 7 includes pairs of rollers 12*a*, 12*b*, 12*c*, 12*d*, 12*e*, and 12*f*, and guides 13*a*, 13*b*, 13*c*, 13*d*, and 13*e*. The roller pairs 12*a* to 12*f* are disposed along the conveyance path, sequentially in this order from the upstream relative to the conveyance direction. One roller out of each roller pairs 12*a* to 12*f* is a drive roller rotated by driving the conveyance motor 7M (see FIG. 4) under control of the controller 9. The other one of each pair is a driven roller which rotates with rotation of the corresponding drive roller. The guides 13*a* to 13*e* disposed along the conveyance path, sequentially from the upstream relative to the conveyance direction, are alternated with the roller pairs 12*a* to 12*f*. Each of the guides 13*a* to 13*e* is made of a pair of plates disposed to face each other.

Under the control by the controller 9, the sheet P fed from the sheet-feeder unit 6 is sandwiched by the roller pairs 12*a* to 12*f* and conveyed in the conveyance direction, through the space between the plates of the guides 13*a* to 13*e*. When the sheet P passes immediately under each head unit 3*x* while being supported by the top surface of the platen 4, ink is ejected from a plurality of ejection openings 30 (see FIG. 3A and FIG. 3B) formed on the opposing face 3*x*1 of each head unit 3*x* towards the surface of the sheet P, under control of the controller 9. The ink ejection is performed from the ejection openings 30 based on the detection signals transmitted from the sheet sensor 5. The sheet P on which an image is formed is discharged to the sheet output unit 11 from an opening 1*a*1 formed at an upper part of the casing 1*a*.

Figure 4:
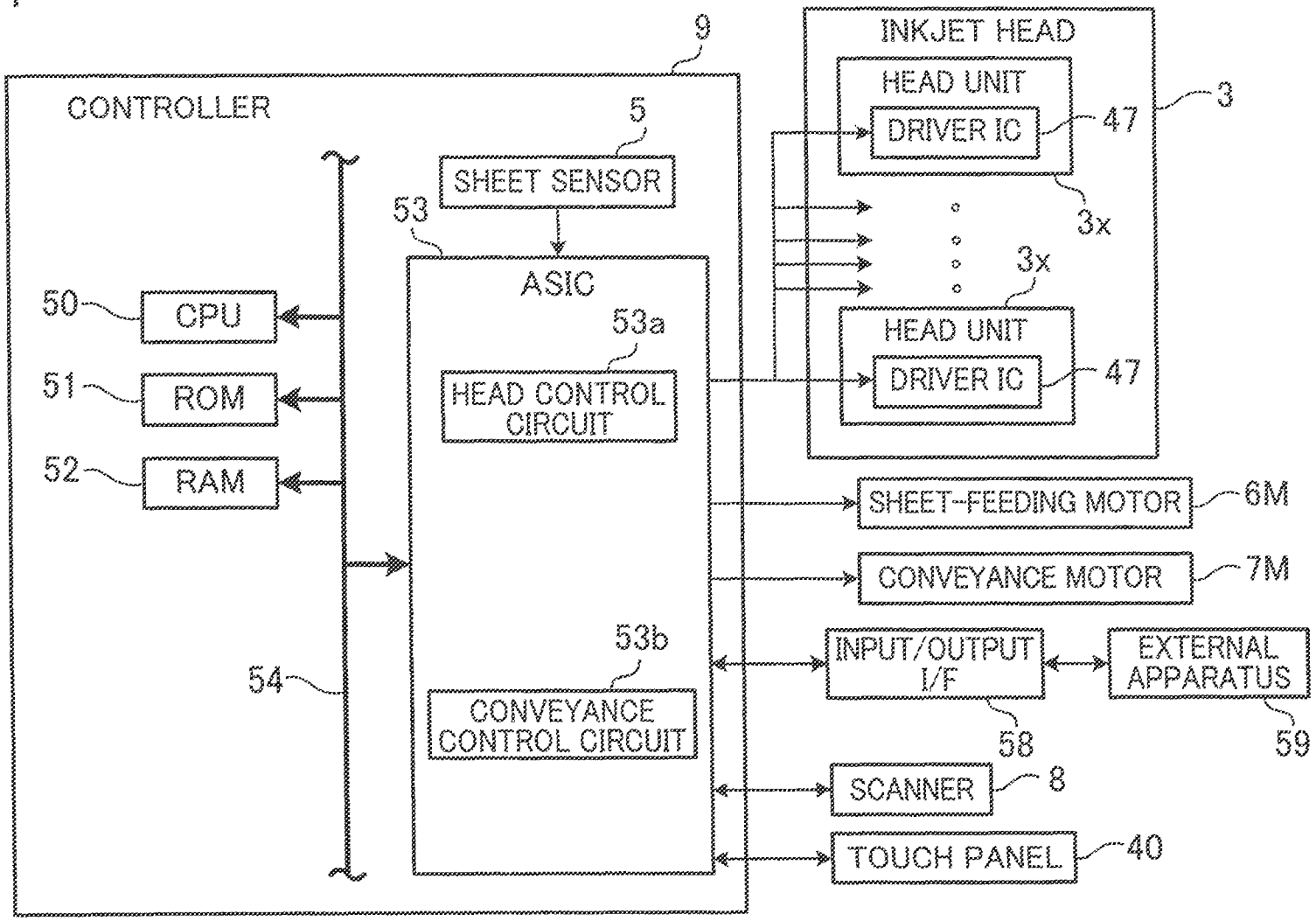
FIG. 4 is a block diagram showing electric configuration of the printer shown in FIG. 1.

As shown in FIG. 4, the controller 9 includes a CPU (Central Processing Unit) 50, a ROM (Read Only Memory) 51, a RAM (Random Access Memory) 52, an ASIC (Application Specific Integrated Circuit) 53, a bus 54, and the like. The ROM 51 stores therein a program run by the CPU 50, various fixed data, and the like. The RAM 52 temporarily stores data needed at a time of running the program (image data or the like). The ASIC 53 includes a head control circuit 53*a* and a conveyance control circuit 53*b*. Further, the ASIC 53 is connected to and in communication with an external apparatus 59 such as a PC (Personal Computer) through an input/output I/F (Interface) 58. Further, the ASIC 53 is connected to devices such as a scanner 8 and a touch panel 40 to be able to communicate therewith. The controller 9 performs, based on the cooperation of the CPU 50 and the ASIC 53, operations such as an image recording operation of recording an image on a sheet P based on recording data input from the external apparatus 59, a pattern group recording operation of recording a later-described pattern group 15 onto the sheet P, and a reading operation of reading the image recorded on the sheet P by using the scanner 8. In the image recording operation and the pattern group recording operation, the head control circuit 53*a* controls the driver IC 47 so that ink is ejected from the ejection openings 30 of the inkjet head 3 and the conveyance control circuit 53*b* controls the sheet-feeding motor 6M and the conveyance motor 7M so that the sheets P are conveyed along the conveyance direction.

Figure 3B:
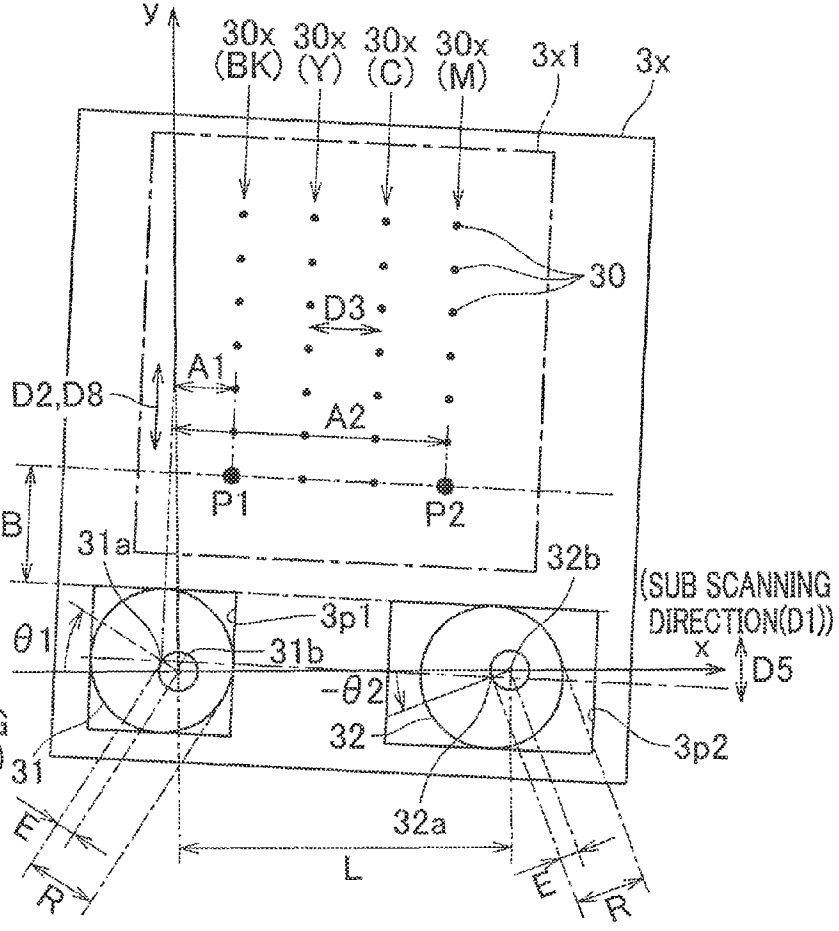
FIG. 3B is a schematic plan view of a position adjusting mechanism for the head unit after adjustment.
Figure 3A:
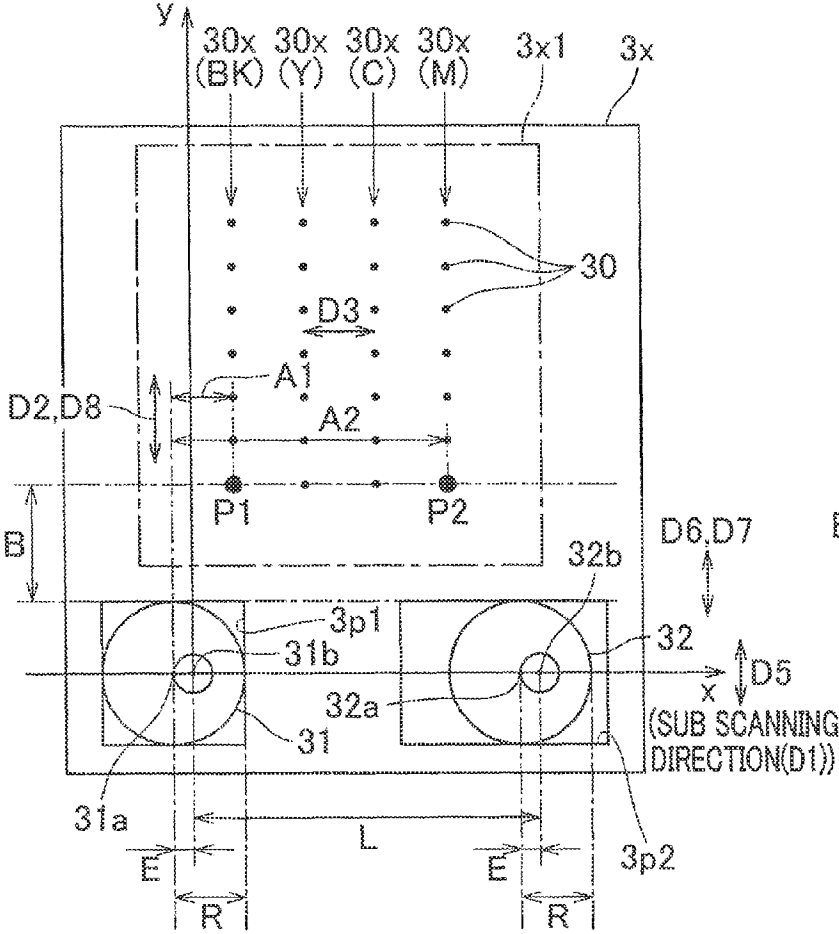
FIG. 3A is a schematic plan view showing a position adjusting mechanism for a head unit before adjustment.

Next, with reference to FIG. 3A and FIG. 3B, the following describes how the ejection openings 30 are disposed on each head unit 3*x*, and a position adjusting mechanism of the head unit 3*x*. Note that the ejection openings 30 are disposed in the same way for all of the six head units 3*x*, and the structure of the position adjusting mechanism is also the same for the head units 3*x*. Therefore, FIG. 3A and FIG. 3B only show a single head unit 3*x* and a position adjusting mechanism provided related to that head unit 3*x*. In FIG. 3, the number of the ejection openings 30 in each ejection opening array 30*x* is different from the actual number for the sake of convenience.

The ejection openings 30 are, on the opposing face 3*x*1, arranged at predetermined ejection opening intervals in the second direction D2 (in the present embodiment, at intervals (about 84 μm) corresponding to the recording density of 300 dpi) and form four ejection opening arrays 30*x* corresponding to black (BK), yellow (Y), cyan (C), and magenta (M) inks, respectively. The four ejection opening arrays 30*x* are aligned in a third direction D3 which is in parallel to the opposing face 3*x*1 and perpendicularly crosses the second direction D2, at predetermined intervals. Furthermore, assuming that virtual linear lines which are in parallel to the third direction D3 and lined up in the second direction D2 at the aforesaid ejection opening intervals are provided, one of the ejection openings 30 in each ejection opening array 30*x* is provided on each virtual linear line.

The position adjusting mechanism includes a first cam 31 and a second cam 32. The cams 31 and 32 have structures and the sizes which are identical to each other. The cams 31 and 32 are disposed in such a manner as to sandwich therebetween the four ejection opening arrays 30*x* relative to the third direction D3. The cams 31 and 32 are provided through holes 3*p*1 and 3*p*2 formed on the head unit 3*x*, and are structured to rotate with their circumferential surfaces being in contact with the surfaces defining the through holes 3*p*1 and 3*p*2 of the head unit 3*x*, respectively. The cams 31 and 32 have rotation centers 31*b* and 32*b* which deviate from the centers 31*a* and 32*a* by a distance E, respectively. Shafts serving as the rotation centers 31*b* and 32*b* extend in a direction perpendicularly crossing the opposing face 3*x*1, and are supported by the casing 1*a*. The through hole 3*p*1, when viewed from the vertical direction, has a square shape with each side having substantially the same length as the diameter of the first cam 31. The through hole 3*p*2 on the other hand has a rectangular shape with two sides having substantially the same length as the diameter of the second cam 32 extended in the second direction D2, and with two sides longer than the diameter of the second cam 32 extended in the third direction D3, when viewed from the vertical direction. Therefore, while the movement of the first cam 31 is restricted in both the second direction D2 and the third direction D3, the movement of the second cam 32 is restricted to the second direction D2, but not in the third direction D3, and is free relative to the third direction D3. The cams 31 and 32 are coupled with not-shown gears and not-shown arms, respectively, and each teeth of the gears rotates the corresponding cam by a predetermined angle. The gears also serve as a lock, and fixing the gear inhibits rotation of the corresponding one of the cams 31 and 32.

A first position P1 and a second position P2 are any given positions designated on the head unit 3*x*. In this embodiment, the centers of the ejection openings 30 in the ejection opening arrays 30*x* corresponding to Black (BK) and Magenta (M), which are positioned closest to the cams 31 and 32 relative to the second direction D2 are the first position P1 and the second position P2, respectively. From the state shown in FIG. 3A, the cams 31 and 32 are assumed to be brought into the state shown in FIG. 3B, by rotating them clockwise by θ1 and −θ2, respectively. In this case, the amounts of travelling of the positions P1 and P2 relative to the main scanning direction are derived by the following Equation 1.

$$\begin{pmatrix} \Delta y1 \\ \Delta y2 \end{pmatrix} = \frac{E}{L}\begin{pmatrix} L-A1 & -A1 \\ L-A2 & -A2 \end{pmatrix}\begin{pmatrix} \Delta\sin\theta 1 \\ \Delta\sin\theta 2 \end{pmatrix} \quad \text{[Equation 1]}$$

Definitions of each symbol in the above Equation 1 are as follows.

Δy1: the amount of travelling of the first position P1 relative to the main scanning direction Δy2: the amount of travelling of the second position P2 relative to the main scanning direction E: distance by which the cams 31 and 32 are deviated R: radii of cams 31 and 32

L: distance between the rotation centers of the cams 31 and 32

B: intervals between the positions P1 and P2 and the cams 31 and 32, relative to the second direction D2

A1: interval between the first position P1 and the center 31*a*, relative to the third direction D3

A2: interval between the second position P2 and the center 31*a*, relative to the third direction D3

Δ sin θ1: the amount of variation of sin θ1 caused by varying θ1

Δ sin θ2: the amount of variation of sin θ2 caused by varying θ2

With rotation of the cams 31 and 32 about the rotation centers 31*b* and 32*b*, the positions P1 and P2 rotate. The first cam 31 rotates the positions P1 and P2 about the rotation center 32*b*, and the second cam 32 rotates the positions P1 and P2 about the rotation center 31*b*. This way the position of each head unit 3*x* is adjustable. That is, with rotation of the positions P1 and P2 by the cams 31 and 32, the position of the head unit 3*x* is adjustable relative to travel including a component of travel in a direction perpendicularly crossing the opposing face 3x1 (hereinafter, "rotational direction") and a component of travel in the second direction D2. Note that Δy1 and Δy2 are determined by both, Δθ1 and Δθ2.

Where the direction perpendicularly crossing a line connecting the first position P1 and the second position P2 is eighth direction D8, the amount of travelling of the first position P1 by the first cam 31 in the eighth direction D8 is a, the amount of travelling of the second position P2 by the first cam 31 in the eighth direction D8 is b, the amount of travelling of the first position P1 by the second cam 32 in the eighth direction D8 is c, and the amount of travelling of the second position P2 by the second cam 32 in the eighth direction D8 is d, ad−bc≠0 (that is, there exists an inverse matrix (Equation 2 below) which is the inverse of the matrix of the above Equation 1). Note that Δθ1 and Δθ2 are determined by both, Δy1 and Δy2.

$$\begin{pmatrix} \Delta\sin\theta 1 \\ \Delta\sin\theta 2 \end{pmatrix} = \frac{1}{E(A2-A1)}\begin{pmatrix} A2 & -A1 \\ L-A2 & -L+A1 \end{pmatrix}\begin{pmatrix} \Delta y1 \\ \Delta y2 \end{pmatrix} \quad \text{[Equation 2]}$$

The sixth direction D6 which is a direction corresponding to the line tangent to rotation about the rotation center 32*b* at the first position P1, and the seventh direction D7 which is the direction corresponding to the line tangent to rotation about the rotation center 31*b* at the second position P2 both include a component of second direction D2. The eighth direction D8 is the same direction as the fifth direction D5 (main scanning direction) before the position adjustment.

The sixth direction D6 and the seventh direction D7 are both preferably directions close to the second direction D2 (substantially the same direction). Further, the sixth direction D6 and the seventh direction D7 are preferably directions close to each other (substantially the same direction).

The closer the sixth direction D6 and the seventh direction D7 are to each other, the better the approximate accuracy of Equation 1. In other words, a difference between 81 and 82 determined based on the approximation equation assuming that the sixth direction D6 and the seventh direction D7 are the same direction and the rotation amounts θ1 and θ2 determined based on an exact formula is reduced, and the accuracy of the position adjustment is improved. Further, the closer the sixth direction D6 and the seventh direction D7 are, the greater the amount of travelling of the head unit 3x for the sizes of the cams 31 and 32. Therefore, with the sixth direction D6 and the seventh direction D7 being close to each other, downsizing of the printer 1 and highly accurate position adjustment become possible.

Note that, of the first to eighth directions D1 to D8, the first direction D1 (sub scanning direction), the fourth direction D4 (main scanning direction), and the fifth direction D5 are each a direction fixed with respect to the casing 1*a*, and is not varied when the head unit 3x rotates. To the contrary, the second direction D2, the third direction D3, and the sixth to eighth directions D6 to D8 are each a direction defined relative to the individual head units 3x, and are varied by rotation of the head unit 3x.

Now, a tilt angle adjustment method of the head unit 3x will be described with reference to FIG. 5. As described above, the ejection openings 30 forming each ejection opening array 30x are arranged along the second direction D2. Providing the second direction D2 to be orthogonal to the first direction D1 is important to ensure the quality of images recorded on the sheets P. In this regard, the second direction D2 may not be orthogonal to the first direction D1 when the components of the printer 1 are assembled. In the present embodiment, the tilt angle of the head unit 3x with respect to the first direction D1 is detected as below, and the posture of the head unit 3x is adjusted in accordance with the detection result. This tilt angle adjustment is, for example, carried out in the production of the printer 1, after the components of the printer 1 are assembled and before the printer 1 is shipped from the factory.

Figure 5:
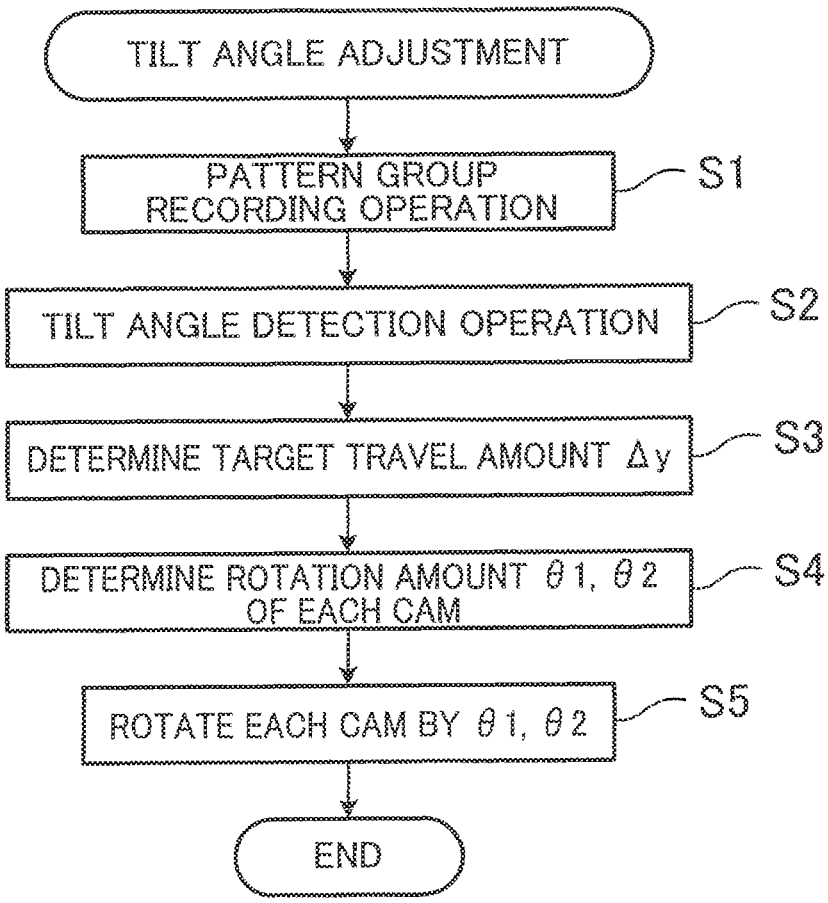
FIG. 5 is a flowchart showing a method of adjusting the tilt angle of the head unit in the printer shown in FIG. 1.

More specifically, as shown in FIG. 5, to begin with, the pattern group recording operation is performed to record the pattern group 15 onto the sheet P (S1). Then the pattern group 15 recorded onto the sheet P is read by the scanner 8, and based on the reading result, the tilt angle detection operation is performed to detect the tilt angle of the head unit 3x of the printer 1 with respect to the first direction D1 (S2). The pattern group recording operation and the tilt angle detection operation will be detailed later.

After S2, Δy1 and Δy2 (target travel amounts of the head unit 3x relative to the main scanning direction) are determined (S3: second process). More specifically, for each of the six head units 3x, Δy1 and Δy2 are determined based on the tilt angle of the head unit 3x with respect to the first direction D1, which has been detected in S2. The "target travel amount" means an amount by which an object should travel (that is, an amount of travelling from the current position to a position where the object should be disposed).

After S3, the rotation amounts Δθ1 and Δθ2 of the cams 31 and 32 are determined (S4: third process). More specifically, for each of the six head units 3x, Δ sin θ1 and Δ sin θ2 are calculated based on Δy1 and Δy2 determined in S3 and Equation (2) above, so that the rotation amounts Δθ1 and Δθ2 are determined to provide such sines. θ1 and θ2 are the rotation amounts of the cams 31 and 32 on the basis of the sub scanning direction, whereas Δθ1 and Δθ2 are amounts of change of θ1 and θ2 before and after the cams 31 and 32 are moved for positional adjustment. In the present embodiment, because θ1 and θ2 are 0 before the positional adjustment, —01 is equal to Δθ1 and θ2 is equal to Δθ1.

After S4, the cams 31 and 32 are rotated clockwise by Δθ1 and Δθ2, respectively (S5: fourth process). Specifically, for each of the six head units 3x, the arm is operated to rotate the gear by the number of tooth corresponding to the Δθ1 and Δ2. This causes the positions P1 and P2 of each of the six head units 3x to move in the main scanning direction by Δy1 and Δy2. At this stage, in accordance with the relationship between Δy1 and Δy2, the tilt angle of the head unit 3x with respect to the first direction D1 (tilt angle of the second direction D2 with respect to the first direction D1) is adjusted. At this time, the six head units 3x may be moved at the same time or separately.

Note that, in the present embodiment, the rotation amounts θ1 and θ2 of the cams 31 and 32 are angles from the sub scanning direction (first direction D1) (see FIG. 3B). The optimum rotation amounts of the cams 31 and 32 with respect to the head unit 3x are angles from a direction (the direction indicated by the dashed line in FIG. 3B) connecting the centers 31*a* and 32*a*, and are slightly different from the θ1 and θ2 of the present embodiment; i.e., an amount resulting from subtraction of the entire rotation amount of the head unit 3x from θ1 and θ2 of the present embodiment. However, if a deviation distance E is sufficiently smaller than the distance between the rotation centers 31*b* and 32*b*, such a difference in, Δθ1 and Δθ2 can be practically counted out.

Through the processes above, the tilt angle of each head unit 3x with respect to the first direction D1 is adjusted.

Now, the pattern group recording operation and the tilt angle detection operation will be described with reference to FIG. 6 to FIG. 11B. Programs for performing the pattern group recording operation and the tilt angle detection operation are stored in the ROM 51. The ROM 51 further stores later-described dot allocation data. It is noted that the following description focuses solely on one head unit 3*x*.

An example of a method for detecting the tilt angle of the head unit 3*x* with respect to the first direction D1 is arranged such that, ink is ejected from the ejection openings 30 corresponding to black (BK) and magenta (M) and recording is carried out on a test sheet P, and the tilt angle is measured by detecting, by using a sensor, the positions of the impacted dots corresponding to the respective ink colors. This method, however, requires a high-resolution sensor, and hence the cost is disadvantageously high and the adjustment cannot be done when such a high-resolution sensor is not available.

Furthermore, because a line-type printer performs recording with the fixed the head unit 3*x*, a deviation of the tilt angle of the head unit 3*x* with respect to the first direction D1 appears as a deviation in the impact positions of formed dots in the fourth direction D4. For this reason, it is impossible to record a pattern on a sheet P while intentionally shifting the impact positions of ink droplets in the fourth direction D4. In the meanwhile, it is possible in a line-type printer to record a pattern on a sheet P while shifting the impact positions of dots in the first direction D1.

For this reason, in the present embodiment, to begin with, a pattern group 15 having a plurality of unit patterns 20 is formed on a sheet P in the pattern group recording operation, as described below. Thereafter, in the tilt angle detection operation, the tilt angle of the head unit 3*x* with respect to the first direction D1 is detected based on the optical densities (equivalent to optical characteristics) of a first region 21 and a second region 22 (both will be described later) of each recorded unit pattern 20. The optical density is an index indicating the degree of overall brightness of each region.

Figure 6:
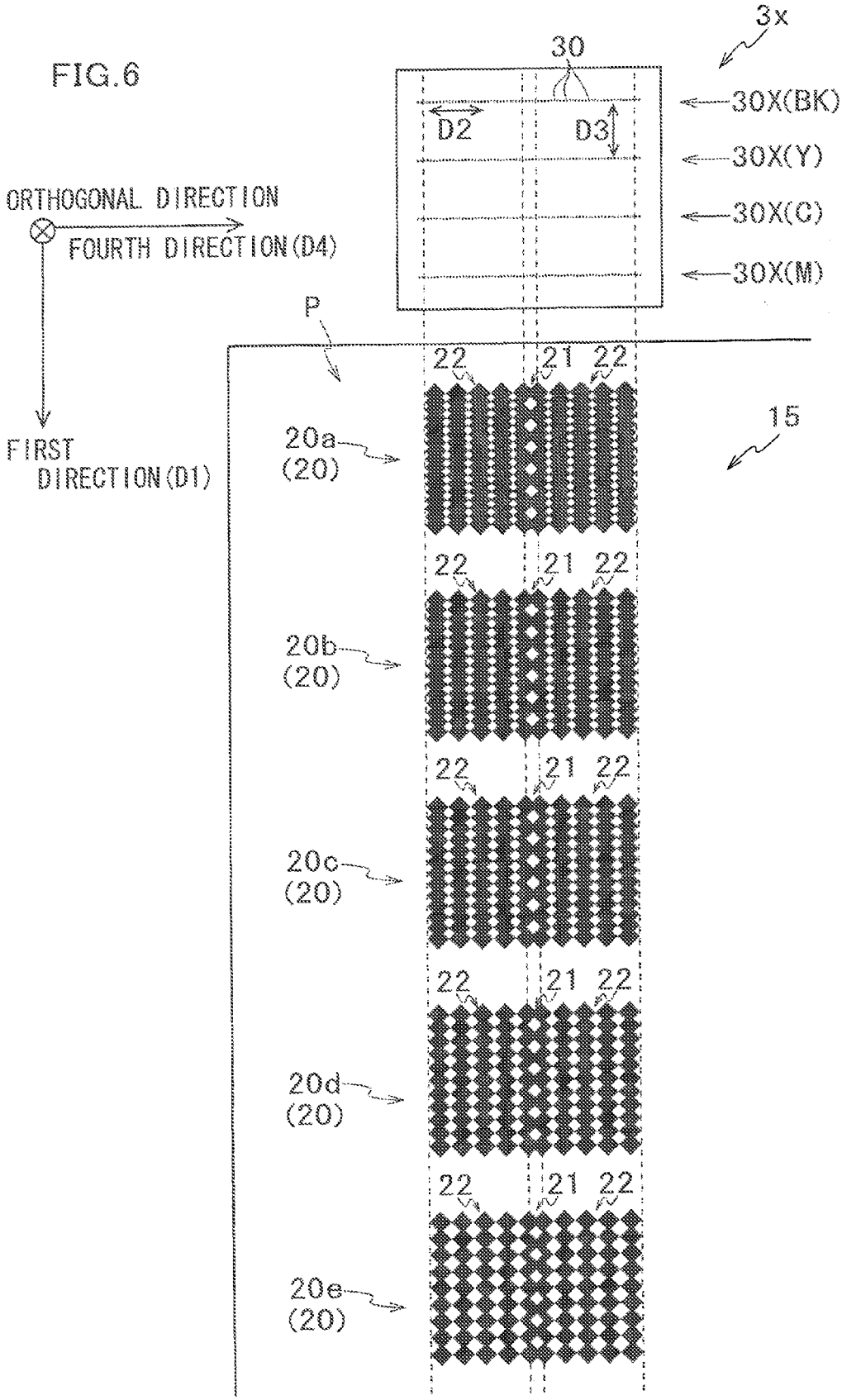
FIG. 6 shows a pattern group.

To begin with, the pattern group recording operation will be detailed. In the pattern group recording operation, the controller 9 forms a pattern group 15 having a plurality of unit patterns 20 (five unit patterns 20*a* to 20*e* in the present embodiment) on a sheet P as shown in FIG. 6, by conveying the sheet P in the first direction D1 by the conveyance unit 7 and at the same time ejecting ink droplets from the ejection openings 30 of the ejection opening array 30*x* (first ejection opening array) corresponding to black (BK) and the ejection opening array 30*x* (second ejection opening array) corresponding to magenta (M).

These unit patterns 20 are recorded on the sheet P at predetermined intervals along the first direction D1. Each of the unit patterns 20 includes the first region 21 which is formed on the sheet P by ink droplets ejected from the ejection openings 30 of both the ejection opening array 30*x* corresponding to black and the ejection opening array 30*x* corresponding to magenta and the second region 22 which is formed on the sheet P by ink droplets ejected from the ejection openings 30 of one of the ejection opening array 30*x* corresponding to black and the ejection opening array 30*x* corresponding to magenta. In the present embodiment, each unit pattern 20 includes two second regions 22 in total, i.e., a second region 22 for the ejection opening array 30*x* corresponding to black and a second region 22 for the ejection opening array 30*x* corresponding to magenta. That is to say, one second region 22 is a region formed on the sheet P by black ink droplets, whereas the other second region 22 is a region formed on the sheet P by magenta ink droplets. These two second regions 22 are disposed to sandwich the first region 21 in the fourth direction D4 and are adjacent to the first region 21. It is noted that the first region 21 and the second regions 22 are not necessarily mutually exclusive in dots. For example, in a single dot, a half of the dot may belong to the first region 21 whereas the other half of the dot may belong to the second region 22.

In addition to the above, each of the first region 21 and the second regions 22 is a region where ink droplets may impact when an image is recorded thereon, and includes not only an a region where ink droplets impacts (hereinafter, impacted region) but also a region where the sheet P is exposed as no ink droplet impacts (hereinafter, blank region). In the present embodiment, as described above, the sheet P is a blank white sheet. For this reason, the optical density of each of the first region 21 and the second regions 22 decreases as the ratio of the blank region with respect to the impacted region increases.

Each of the first region 21 and the second regions 22 of the unit patterns 20 is recorded based on dot allocation data stored in the ROM 51. The dot allocation data indicates the dot allocation of the first region 21 and the dot allocation of the second regions 22 in each of the unit patterns 20. The dot allocation is information about the color, the dot size, and the positions of ink. For example, when a dot in which the color of ink is i and the dot size is j is represented as $D_{ij}$, the dot allocation is information represented by a two-dimensional array $\{D_{ij}\}$ of two-dimensionally arranging the dot in the first direction D1 and the fourth direction D4.

Figure 7A:
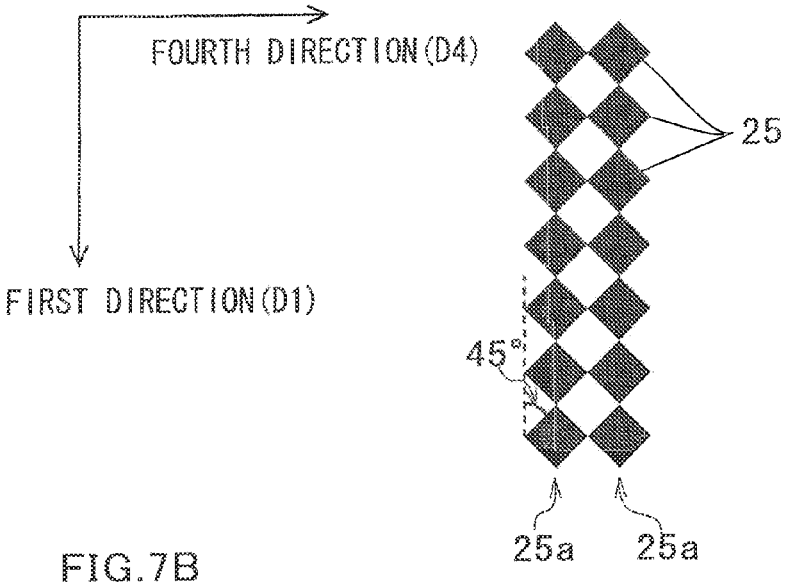
FIG. 7A illustrates the dot allocation of the first region of a unit pattern.

The dot allocation of the first region 21 of each unit pattern 20 is arranged such that the optical density varies in accordance with dot intervals in the fourth direction D4 of the dots formed by the ink droplets impacted on the sheet P. More specifically, as shown in FIG. 7A, the dot allocation is arranged in such a way that two figure arrays 25*a* in each of which a plurality of first figures 25 are lined up in the first direction D1 are lined up in the fourth direction D4. In the present embodiment, each first FIG. 25 has a diamond shape with each side forming an angle of 45 degrees with the first direction D1. A diagonal line of this diamond-shaped first FIG. 25 is in parallel to the first direction D1.

Between the unit patterns 20, the first regions 21 are identical in dot allocation. That is to say, in the pattern group recording operation, the same image is recorded on the first regions 21 of the respective unit patterns 20. With this, the first regions 21 of the unit patterns 20 are identical in optical density.

Figure 8B:
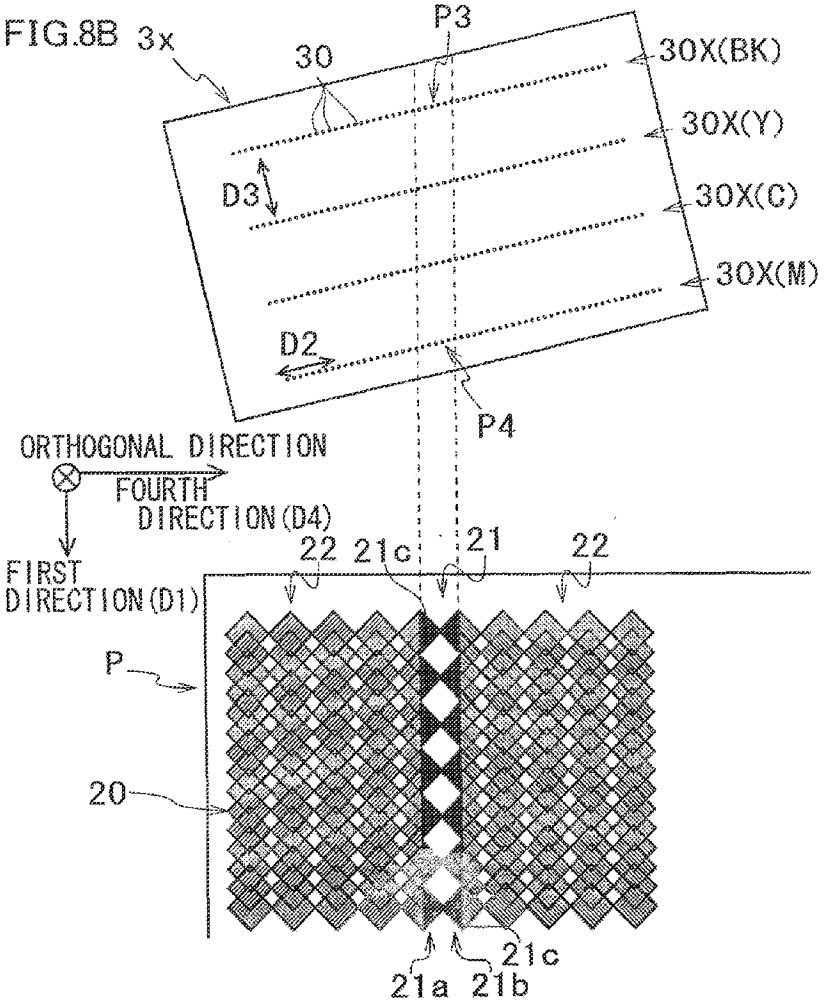
FIG. 8B illustrates the first region of the unit pattern.
Figure 8A:
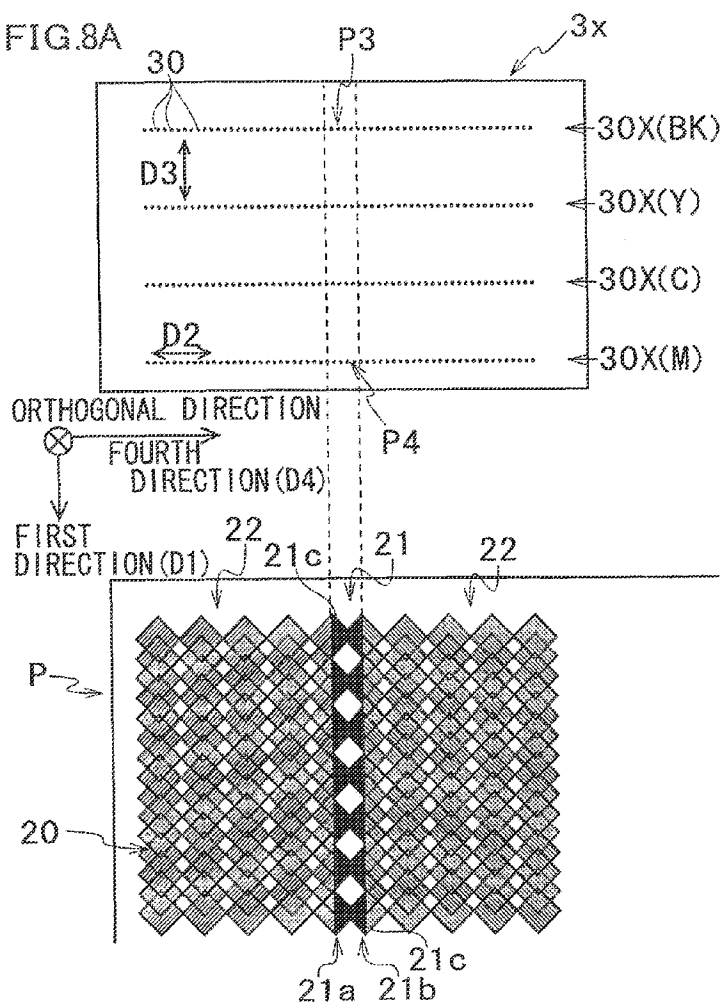
FIG. 8A illustrates the first region of the unit pattern.

In the present embodiment, as shown in FIG. 8A and FIG. 8B, based on the information regarding one figure array 25*a* in the dot allocation of the first region 21, ink droplets are ejected from the ejection openings 30 of the ejection opening array 30*x* corresponding to black so that an image 21*a* is recorded on the sheet P, whereas, based on the information regarding the other figure array 25*a* in the dot allocation, ink droplets are ejected from the ejection openings 30 of the ejection opening array 30*x* corresponding to magenta so that an image 21*b* is recorded on the sheet P. Each of the images 21*a* and 21*b* is arranged such that figures 21*c* corresponding to the first FIG. 25 are lined up in the first direction D1.

In this regard, as shown in FIG. 8A and FIG. 8B, in the ejection opening array 30*x* corresponding to black, the center of an ejection opening 30 used for the recording of the first region 21 is set as a third position P3. Furthermore, in the ejection opening array 30*x* corresponding to magenta, the center of an ejection opening 30 used for the recording of the first region 21 is set as a fourth position P4. The third position P3 and the fourth position P4 are centers of ejection openings 30 which are adjacent to each other in the second direction D2.

The distance between (relative positions of) the third position P3 and the fourth position P4 in the fourth direction D4 varies in accordance with the tilt angle of the head unit 3*x* with respect to the first direction D1. For example, in the state shown in FIG. 8B in which the head unit 3*x* has been rotated anticlockwise for a predetermined angle from the state shown in FIG. 8A, the distance between the third position P3 and the fourth position P4 in the fourth direction D4 is widened. As the distance between the third position P3 and the fourth position P4 in the fourth direction D4 is varied, the distance (dot distance) between the images 21*a* and 21*b* which are to be recorded on the sheet P is also varied. As a result, the ratio of the blank region with respect to the impacted region is also varied, so that the optical density of the first region 21 is changed. Therefore, as, for example, the distance between the third position P3 and the fourth position P4 in the fourth direction D4 increases, the ratio of the blank region with respect to the impacted region increases in the first region 21, with the result that the optical density in the first region 21 is decreased. For example, comparing FIG. 8A with FIG. 8B, the distance between the third position P3 and the fourth position P4 in the fourth direction D4 is longer and the ratio of the blank region with respect to the impacted region is higher in FIG. 8B than FIG. 8A. For this reason, the optical density of the first region 21 is lower in FIG. 8B than in FIG. 8A. As described above, when the tilt angle of the head unit 3*x* in the first direction D1 is varied, the optical density of the first region 21 becomes different. In FIG. 8A and FIG. 8B, for convenience of explanation, a region in the first region 21 where ink droplets impact is depicted in black, whereas a region in the second region 22 where ink droplets impact is hatched.

Figure 7B:
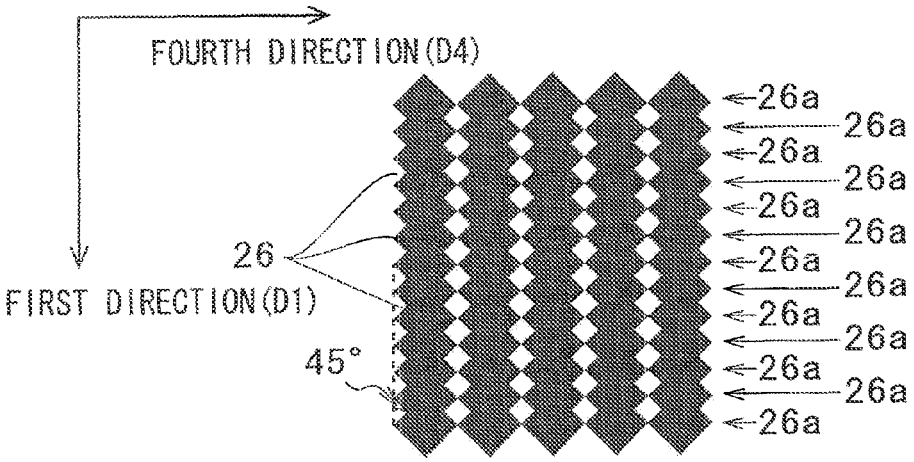
FIG. 7B illustrates the dot allocation of the second region of the unit pattern.
Figure 7C:
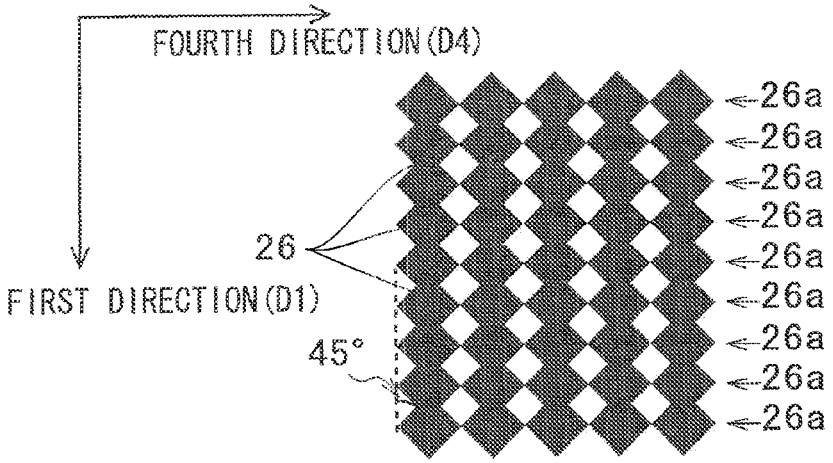
FIG. 7C illustrates the dot allocation of the second region of the unit pattern.

In the meanwhile, the dot allocation of the second region 22 in each of the unit patterns 20 is arranged such that the optical density varies in accordance with the dot intervals in the first direction D1 of the dots formed on the sheet P by the impacted ink. More specifically, as shown in FIG. 7B and FIG. 7C, the dot allocation is arranged in such a way that a plurality of figure arrays 26 in each of which second figures 26 are lined up in the fourth direction D4 are lined up in the first direction D1. In the present embodiment, each second FIG. 26 has, in the same manner as the first figures 25, a diamond shape with each side forming an angle of 45 degrees with the first direction D1. The first FIG. 25 and the second FIG. 26 are 90-degree rotational symmetric with each other and are translational symmetric with each other.

Between the unit patterns 20, the dot allocation of the second region 22 is different. The unit patterns 20 are therefore different from one another in the optical density of the second region 22. More specifically, the dot allocation of the second region 22 is different in the intervals (array density) of the figure arrays 26*a* in the first direction D1. For example, the intervals of the figure arrays 26*a* in the first direction D1 in the dot allocation in the second region 22 of the unit pattern 20*c* (see FIG. 7B) are shorter than the intervals in the dot allocation in the second region 22 of the unit pattern 20*e* (see FIG. 7C). In the dot allocation in the second region 22, the second figures 26 of the respective figure arrays 26 which are adjacent to each other in the first direction D1 may be overlapped. In other words, in the dot allocation in the second region 22, a plurality of dots may be allocated at the same position.

Figure 9:
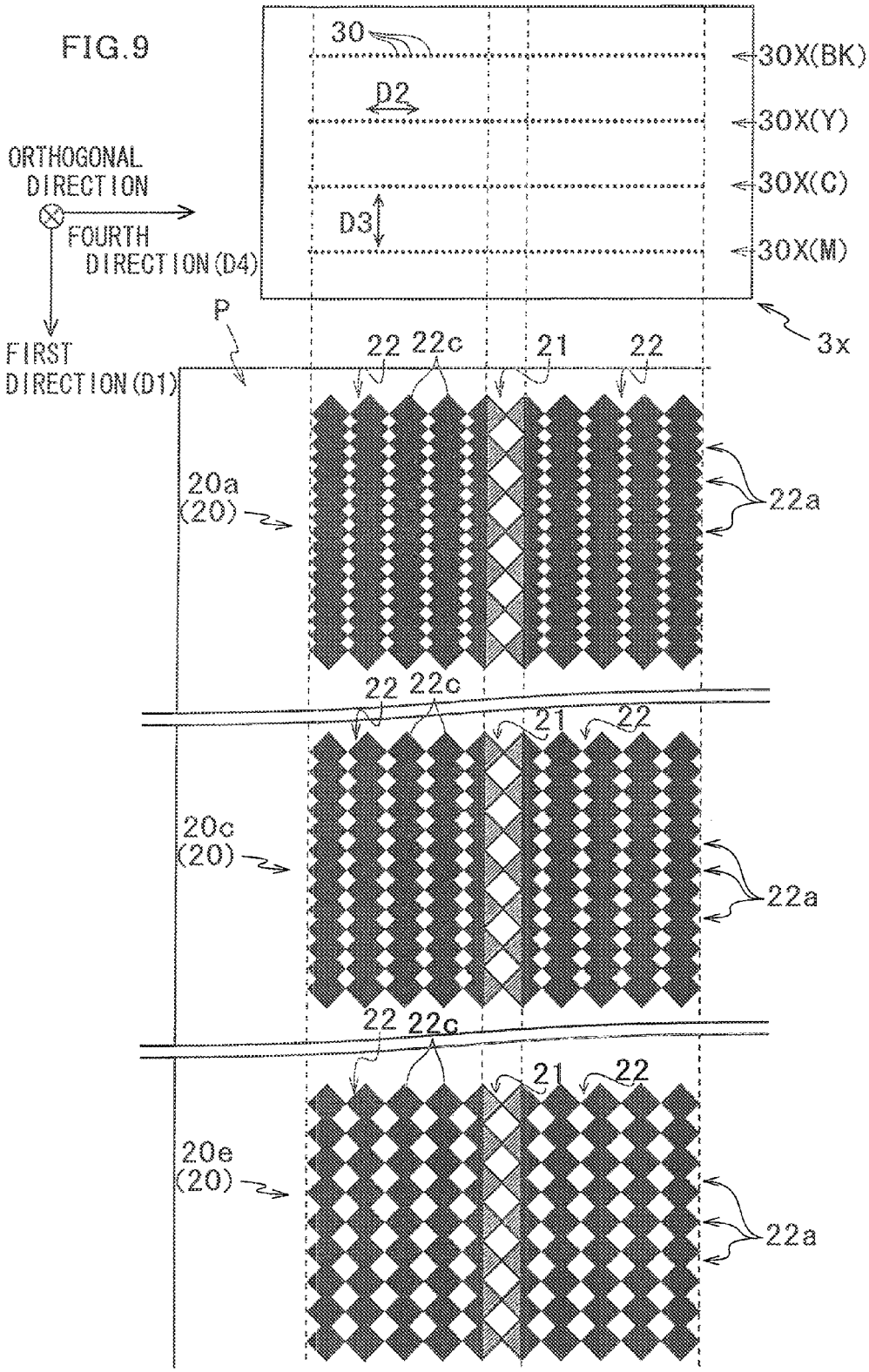
FIG. 9 illustrates the second region of the unit pattern.

Based on such dot allocation in the second region 22, ink is ejected from the ejection openings 30 of the head unit 3*x*, so that the images 22*a* corresponding to the figure arrays 26*a* are lined up in the first direction D1 in the second region 22, as shown in FIG. 9. Each image 22*a* is arranged such that the figures 22*c* corresponding to the second figures 26 are lined up in the fourth direction D4. In FIG. 9, for convenience of explanation, a region in the second region 22 where ink droplets impact is depicted in black, whereas a region in the first region 21 where ink droplets impact is hatched. Furthermore, in FIG. 9, the intervals of the images 21*a* and 21*b* in the fourth direction D4 in the first region 21 are different from those shown in FIG. 6.

In the present embodiment, the unit patterns 20 are identical in length in the first direction D1. For this reason, in the unit patterns 20, the dot allocation in each second region 22 is arranged such that the number of figure arrays 26*a* is large when the intervals of the figure arrays 26*a* are short in the first direction D1. For this reason, in the unit patterns 20, when according to the dot allocation the intervals of the figure arrays 26*a* in the first direction D1 are short in the second region 22, the ratio of the blank region with respect to the impacted region is decreased, and hence the optical density of the second region 22 is increased. For example, as shown in FIG. 9, the optical density of the second region 22 of the unit pattern 20*c* is therefore higher than the optical density of the second region 22 of the unit pattern 20*e*.

According to the present embodiment, in the pattern group recording operation, the first region 21 is recorded based only on information of the halves of the figures of the two figure arrays 25*a*, which halves are on the neighboring side, in the dot allocation of the first region 21. More specifically, as shown in FIG. 8A and FIG. 8B, the recording is performed in such a way that the FIG. 21*c* of each of the images 21*a* and 21*b* of the first region 21 is a half-diamond formed by halving the diamond shape in the fourth direction D4, and the diagonal line of the half-diamond along the first direction D1 contacts with the second region 22. Regarding the information of the second FIG. 26 corresponding to the FIG. 21*c* neighboring to the first region 21 among the second figures 26 in the dot allocation in the second region 22, the second region 22 is recorded based only on the information of the half-diamond on the side opposite to the first region 21. More specifically, as shown in FIG. 9, the recording is performed in such a way that the FIG. 22*c* of the image 22*a* of the second region 22 neighboring to the first region 21 has a half-diamond shape halved in the fourth direction D4, and the diagonal line of the half-diamond in the first direction D1 contacts with the first region 21. With this, as the recording is performed in such a way that two second regions 22 are disposed to sandwich the first region 21 in the fourth direction D4 and to be adjacent to the first region 21, the user is able to easily recognize the difference between the optical density of the first region 21 and the optical densities of the second regions 22 in each unit pattern 20. As a variation, the first region 21 may be recorded using the entire information of the dot allocation of the first region 21, and the second region 22 may be recorded using the entire information of the dot allocation of the second region 22. In this case, the FIG. 21*c* in each of the images 21*a* and 21*b* in the first region 21 and the FIG. 22*c* of each image 22*a* in the second region 22 are all diamond-shaped.

In addition to the above, as described above, the first FIG. 25 and the second FIG. 26 are translational symmetric with each other in the present embodiment. For this reason, the pattern recorded in the first region 21 is similar to the pattern recorded in the second region 22, and hence the difference between the optical density in the first region 21 and the optical density in the second region 22 in each unit pattern 20 is visually easily recognizable by the user.

In addition to the above, the first FIG. 25 has a diamond shape with the sides forming an angle of 45 degrees with the first direction D1. In other words, the first FIG. 25 has an outline forming a predetermined angle which is neither 0 nor 90 degrees with the first direction D1. It is therefore possible to increase the rate of change in the optical density of the first region 21 in response to a change in the intervals between the images 21*a* and 21*b* in the fourth direction D4 in the first region 21. Likewise, the second FIG. 26 has a diamond shape having a side forming an angle of 45 degrees with the first direction D1. It is therefore possible to increase the rate of change in the optical density of the second region 22 with respect to a change in the intervals of the images 22*a* in the first direction D1 in the second region 22. This makes it possible to further precisely detect the difference between the optical density of the first region 21 and the optical density of the second region 22 in each unit pattern 20.

As the unit patterns 20 are recorded on the sheet P in the manner as described above, the first region 21 is arranged to be a region with the optical density varied in accordance with the interval between the third position P3 and the fourth position P4 in the fourth direction D4. Furthermore, while the optical densities of the first regions 21 of the unit patterns 20 are identical, the optical densities of the second regions 22 are different.

Furthermore, as described above, the first FIG. 25 and the second FIG. 26 are 90-degree rotational symmetric with each other. On this account, the correspondence relation between the intervals between the images 21*a* and 21*b* in the fourth direction D4 in the first region 21 and the optical density of the first region 21 is identical with the correspondence relation between the intervals of the images 22*a* in the first direction D1 in the figure arrays 26*a* of the second region 22 and the optical density of the second region 22. That is to say, in the present embodiment, when the optical density of the first region 21 is identical with an average optical density of two second regions 22 are identical, the intervals between the images 21*a* and 21*b* in the fourth direction D4 in the first region 21 are identical with the intervals of the images 22*a* in the first direction D1 in the second region 22.

As described above, the selection of a unit pattern 20 in which the optical density of the first region 21 is identical with an average optical density of two second regions 22 is equivalent to the selection of a unit pattern 20 in which the intervals between the images 22*a* in the first direction D1 in the second region 22 are identical with the intervals between the images 21*a* and 21*b* in the fourth direction D4 in the first region 21.

In addition to the above, the intervals between the images 22*a* in the first direction D1 in the second region 22 are calculated from the intervals between the figure arrays 26*a* in the first direction D1 in the dot allocation of the second region 22. For this reason, by selecting a unit pattern 20 in which the average optical density of the second regions 22 are closest to the optical density of the first region 21 among the unit patterns 20, the intervals of the images 21*a* and 21 *b* in the fourth direction D4 in the first region 21 (i.e., the interval between the third position P3 and the fourth position P4 in the fourth direction D4) are calculated from the selected unit pattern 20, and hence the tilt angle of this head unit 3*x* with respect to the first direction D1 is obtained.

In the present embodiment, the pattern group 15 is constituted by the unit pattern 20*c* which functions as a reference and the other unit patterns 20*a*, 20*b*, 20*d*, and 20*e*. The dot allocation of the unit pattern 20*c* is arranged such that the intervals of the figure arrays 26*a* in the first direction D1 are identical with the intervals between the images 21*a* and 21*b* in the fourth direction D4 when the head unit 3*x* is disposed at a desired tilt angle with respect to the first direction D1 (i.e., when the second direction D2 is orthogonal to the first direction D1). That is to say, when the optical density of the first region 21 and the average optical density of the second regions 22 are identical in the unit pattern 20*c*, the second direction D2 is orthogonal to the first direction D1 and an image is recorded on the sheet P without any deviations in the impact positions of the dots.

In the meanwhile, the dot allocation of each of the unit patterns 20*a*, 20*b*, 20*d*, and 20*e* is arranged such that the intervals of the figure arrays 26*a* in the first direction D1 are different from the intervals of the figure arrays 26*a* in the first direction D1 in the dot allocation of the unit pattern 20*c*, each by a predetermined degree (hereinafter, deviation degree). More specifically, in the present embodiment, the deviation degree in the unit pattern 20*b* is −20 μm, and the deviation degree in the unit pattern 20*a* is −40 μm. The deviation degree in the unit pattern 20*d* is +20 μm and the deviation degree in the unit pattern 20*e* is +40 μm.

The deviation degrees of the respective unit patterns 20*a*, 20*b*, 20*d*, and 20*e* indicate differences between the current intervals between the third positions P3 and the fourth positions P4 in the fourth direction D4 and the desired intervals in the fourth direction D4. For example, when the optical density of the first region 21 and the average optical density of the second regions 22 are identical in the unit pattern 20*b*, it is indicated that the current interval between the third position P3 and the fourth position P4 in the fourth direction D4 is shorter than the desired interval in the fourth direction D4 by 20 μm.

Figure 10:
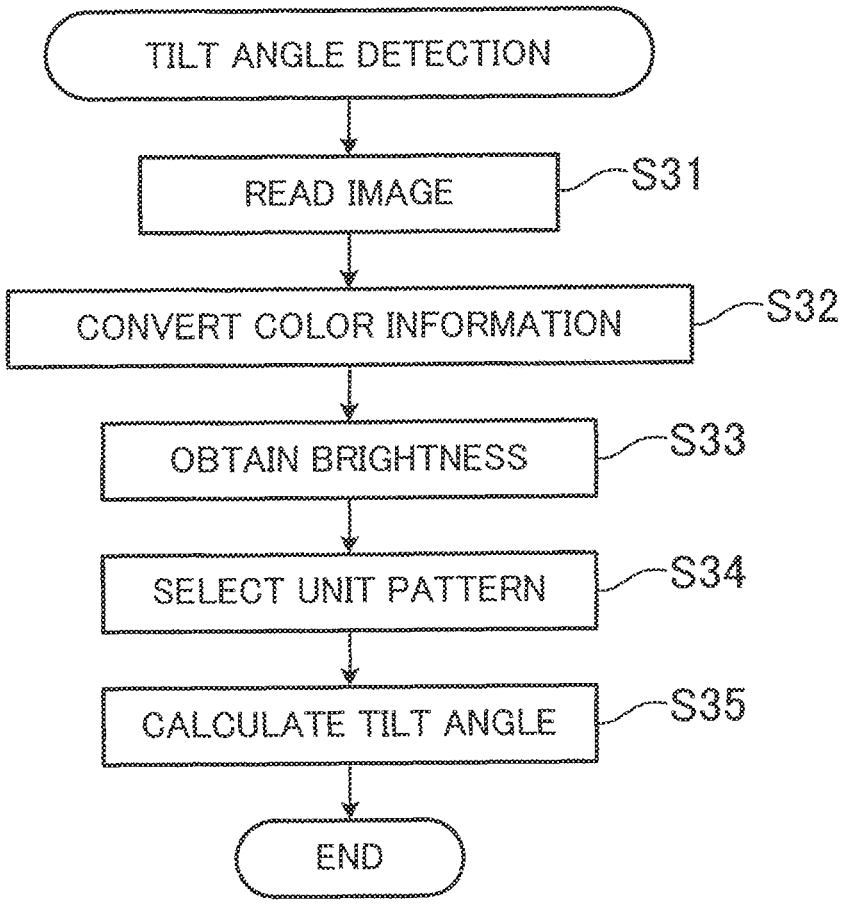
FIG. 10 is a flowchart of a tilt angle detection method for the head unit.

Now, the tilt angle detection operation will be detailed with reference to FIG. 10. In the tilt angle detection operation, to begin with, the controller 9 reads the image on the sheet P on which the unit patterns 20 are recorded, by using the scanner 8 (S31).

Thereafter, the controller 9 conducts grayscale conversion in order to convert the color information of magenta dots impacted on the first region 21 and the second regions 22 to black color information (S32: conversion process). By this conversion, the difference between the brightness (optical density) of the impacted region where black ink droplets impact and the brightness of the impacted region where magenta ink droplet impact is reduced, in each of the first region 21 and the second regions 22. This makes it possible to easily recognize the difference between the optical density of the first region 21 and the optical densities of the second regions 22.

Subsequently, the controller 9 obtains the brightness of the first region 21 and an average brightness of two second regions 22 in each of the unit patterns 20 (S33). It is noted that the acquisition of the brightness of the first region 21 and the average brightness of two second regions 22 of each unit pattern 20 is equivalent to the acquisition of the optical density of the first region 21 and an average optical density of two second regions 22.

Figure 11A:
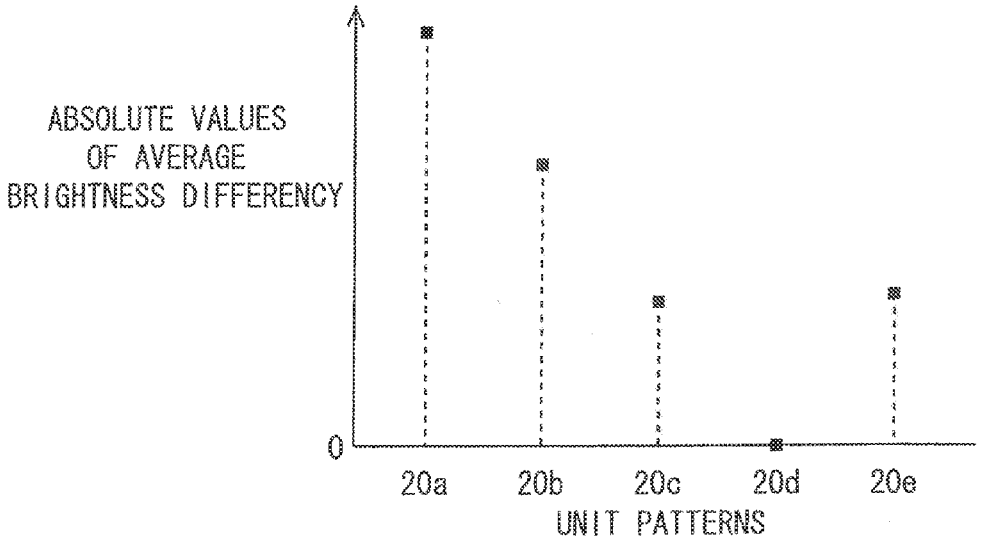
FIG. 11A shows differences in average brightness between the first regions and the second regions of the unit patterns.

The controller 9 then calculates the absolute value of the difference between the brightness of the first region 21 and the average brightness of two second regions 22 (hereinafter, average brightness difference) of each of the unit patterns 20. FIG. 11A shows calculation results of the absolute values of the average brightness differences in the unit patterns 20, measured by the scanner 8. The absolute values of the average brightness differences shown in FIG. 11A correspond to the reference numbers of the respective unit patterns 20 shown in FIG. 6.

In this regard, as shown in FIG. 6, in the unit pattern 20*d*, the ratio of the blank region with respect to the impacted region in the first region 21 is substantially identical with the ratio of the blank region with respect to the impacted region in the second regions 22. On this account, the average brightness of the first region 21 and the average brightness of two second regions 22 in the unit pattern 20*d* are substantially identical, and the absolute value of the average brightness difference in the unit pattern 20*d* is substantially zero as shown in FIG. 11A. In the meanwhile, in the unit patterns 20*a*, 20*b*, and 20*c*, the brightness of the first region 21 is smaller than an average brightness of two second regions 22, whereas in the unit pattern 20*e* the brightness of the first region 21 is higher than an average brightness of two second regions 22. For this reason, the absolute values of the average brightness differences of the unit patterns 20*a*, 20*b*, 20*c*, and 20*e* are larger than the absolute value of the average brightness difference of the unit pattern 20*d*.

The controller 9 selects a unit pattern 20 having the lowest absolute value of the average brightness difference, based on the above-described result of the calculation of the absolute values of the average brightness differences (S34: selection process). By calculating, from the deviation degree of the selected unit pattern 20, the interval between the third position P3 and the fourth position P4 in the fourth direction D4 (i.e., the interval between the images 21*a* and 21*b* in the first region 21 in the fourth direction D4), the tilt angle of the head unit 3*x* with respect to the first direction D1 is obtained (S34: calculation process).

Figure 11B:
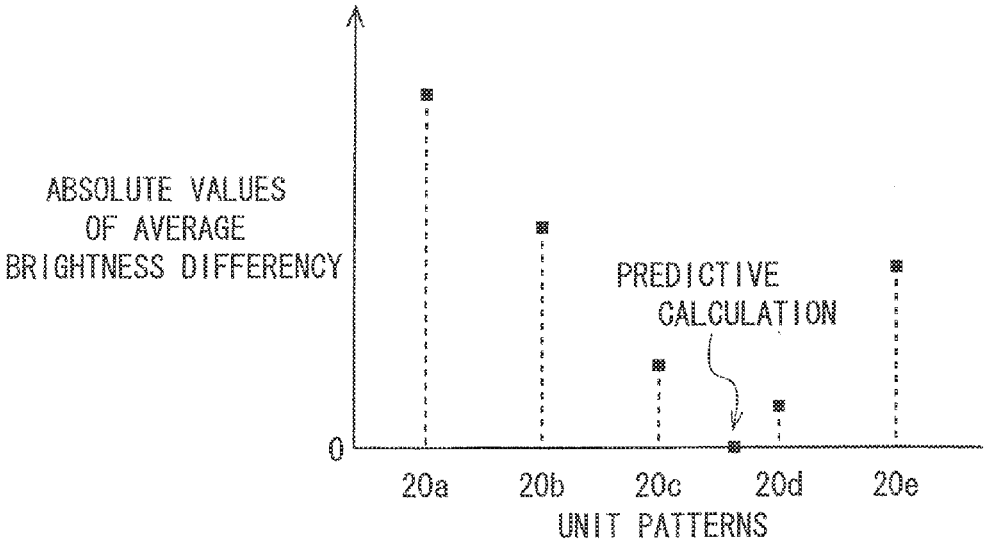
FIG. 11B shows differences in average brightness between the first regions and the second regions of the unit patterns.

As a variation, the absolute values of the average brightness differences obtained from the respective unit patterns 20 may be fitted to a curve, and the tilt angle of the head unit 3*x* with respect to the first direction D1 may be calculated from the curve. More specifically, as the absolute values of the average brightness differences obtained from the respective unit patterns 20 are fitted to a curve by, for example, a least-squares method utilizing a Gaussian function, an error between the current interval between the third position P3 and the fourth position P4 in the fourth direction D4 and the desired interval in the fourth direction D4 is predictively calculated from the parameter of the Gaussian function after the fitting. As such, the curve fitting makes it possible to calculate the error with a high resolution. Furthermore, for example, as shown in FIG. 11B, even if there is no unit pattern 20 in which the absolute value of the average brightness difference is substantially zero, it is possible to predictively calculate the error by using the absolute values of the average brightness differences calculated from the respective unit patterns 20. This makes it possible to obtain the tilt angle of the head unit 3*x* with respect to the first direction D1, with a high resolution.

In the present embodiment, as described above, when the absolute value of the brightness difference is calculated, an average brightness of two second regions 22 of each unit pattern 20 is used as an average brightness of the second regions 22. As such, when an average brightness of two second regions 22 corresponding to respective ejection opening arrays 30*x* is used, the tilt angle of the head unit 3*x* with respect to the first direction D1 is precisely obtained even when the unit pattern 20 is recorded by impacted ink droplets with different colors or when the droplets ejected from the ejection opening arrays 30*x* are different from one another in the dot size or the like on account of a manufacturing error.

As hereinabove described, instead of individually performing movement in the rotational direction and that in the parallel direction to adjust the position, the present embodiment adjusts the position of the head units 3*x* by using the cams 31 and 32 to rotate the first position P1 and the second position P2 about the rotation centers 31*b* and 32*b*. That is, instead of perceiving the position adjustment of the head units 3*x* as a combination of movement in the rotational direction and that in the parallel direction, the present embodiment perceives the same simply as the movement of two predetermined points, i.e., positions P1 and P2 on each of the head units 3*x*, and collectively performs adjustment relative to both the rotational directions and the parallel direction (in the present embodiment, main scanning direction). This, as compared with adjustment based on the former perception, enables accurate position adjustment with a simple process and a simple structure, and complex processes or large-scale machines are not necessary.

The sixth direction D6 and the seventh direction D7 both include a component of the sub scanning direction. This enables position adjustment relative to the lateral direction of the sheet P. To add this, it is possible to minimize the rotation amount (adjustment range) of the cams 31 and 32 for the amount of movement of the head unit 3*x* relative to the lateral direction of the sheet P. Therefore, highly accurate position adjustment of the head unit 3*x* relative to the lateral direction (fourth direction D4) of the sheet P is possible.

The printer 1 is structured so that $ad-bc\neq 0$, where the direction perpendicularly crossing a line connecting the first position P1 and the second position P2 is eighth direction D8, the amount of travelling of the first position P1 by the first cam 31 in the eighth direction D8 is a, the amount of travelling of the second position P2 by the first cam 31 in the eighth direction D8 is b, the amount of travelling of the first position P1 by the second cam 32 in the eighth direction D8 is c, and the amount of travelling of the second position P2 by the second cam 32 in the eighth direction D8 is d. In this case, there will always be a combination of, $\Delta\theta 1$ with $\Delta\theta 2$, the position of each head unit 3*x* is reliably adjustable by the cams 31 and 32.

Adjusters for rotating the positions P1 and P2 of the head unit 3*x* include the cams 31 and 32 each of which rotates about an axis perpendicularly crossing the opposing face 3*x*1. It is therefore possible to realize highly accurate adjusters having little play, with a simple structure.

Further, the structures and the sizes of the cams 31 and 32 of the present embodiment are the same. The rotation amounts of the cams 31 and 32 are therefore determined with a more simple equation. To add this, since the identical components are used for the cams 31 and 32, it is possible to manufacture the printer 1 at a low cost.

Further, in the present embodiment, the rotation center 31*b* of the cam 31 corresponds to the axis of rotation of the cam 32, and the rotation center 32*b* of the cam 32 corresponds to the axis of rotation of the cam 31. The rotation center of the cam of one of the adjusters serves as an axis for the rotation of the entire printer 1 by means of the other adjuster. Therefore, unlike a case of separately providing a rotation center of a cam and the axis of rotation caused by an adjuster, each adjuster is realized with a simple structure.

The sixth direction D6 and the seventh direction D7 both include a component of the second direction (direction in which the ejection opening 30 are arranged) D2. Therefore, it is suitable for an inkjet liquid ejection apparatus such as the one described in the present embodiment.

The positions of each head unit 3*x* relative to the rotational direction and the second direction D2 are adjustable by rotation of the positions P1 and P2 with the use of the cams 31 and 32.

The cams 31 and 32 are disposed in such a manner as to sandwich the four ejection opening arrays 30*x* therebetween, relative to the third direction D3. The greater the interval between the cams 31 and 32 relative to the third direction D3, the better the accuracy and efficiency of the position adjustment relative to the second direction D2 becomes ("efficiency" here means an amount of travelling of the head unit 3*x* for the rotation amounts of the cams 31 and 32). This improves the accuracy and the efficiency of the position adjustment relative to the second direction D2, while restraining an increase in the size.

The sixth direction D6 and the seventh direction D7 both include a component of the fifth direction (direction in which the six head units 3*x* are arranged) D5. The cams 31 and 32 are provided to each of the six head units 3*x*. For each of the six head units 3*x*, the steps S1 to S5 relating to the position adjustment are performed. In this case, a head 3 long in the fifth direction D5 is structured by using a plurality of head units 3*x* short in the fifth direction D5. Although this structure necessitates adjustment of the positional relation among the head units 3*x*, the position adjusting mechanism such as the one described in the present embodiment enables accurate position adjustment with a simple process and a simple structure.

Further, in the present embodiment, the centers 31*a* and 32*a* and the rotation centers 31*b* and 32*b* of the cams 31 and 32 are aligned in one row relative to the sub scanning direction, before adjustment (see FIG. 3A). This maximizes the amount of travelling of each head unit 3*x* relative to the main scanning direction, for the rotation amounts of the cams 31 and 32.

In the present embodiment, in regard to the unit patterns 20 recorded on the sheet P by the pattern group recording operation, the first region 21 of the unit pattern 20 has an optical density which varies in accordance with the tilt angle of the head unit 3*x* with respect to the first direction D1. For this reason, the optical densities of the first regions 21 of the respective unit patterns 20 are identical with one another. In the meanwhile, the second regions 22 of each unit patterns 20 are recorded based on the dot allocation with which the optical density varies in accordance with the intervals of the dots formed by the impacted ink droplets in the first direction D1. Furthermore, because the dot allocations of the second regions 22 are different from each other, the optical densities of the second regions 22 are different from each other. Because of the above, by selecting, from the unit patterns 20, the unit pattern 20 in which the average optical density of the second regions 22 are closest to the optical density of the first region 21, the tilt angle of the head unit 3*x* with respect to the first direction D1 is calculated based on the optical densities of that second regions 22. Furthermore, because the tilt angle of the head unit 3*x* with respect to the first direction D1 is detected by selecting the unit pattern 20 in which the average optical density of the second regions 22 are closest to the optical density of the first region 21, it is unnecessary to employ a high-resolution sensor, and this contributes to the cost reduction.

In addition to the above, the first FIG. 25 and the second FIG. 26 are 90-degree rotational symmetric with each other. This makes it possible to arrange the correspondence relation between the interval of the images 21*a* and 21*b* in the fourth direction D4 in the first region 21 and the optical density of the first region 21 to be identical with the correspondence relation between the intervals of the images 22*a* of the figure arrays 26*a* in the second region 22 in the first direction D1 and the optical densities of the second regions 22.

Furthermore, each of the first FIG. 25 and the second FIG. 26 has an outline which forms a predetermined angle which is neither 0 degree nor 90 degrees with the first direction D1. It is therefore possible to increase the rate of change in the optical density of the first region 21 in response to a change in the interval between the images 21*a* and 21*b* in the fourth direction D4 in the first region 21. Similarly, it is possible to increase the rate of change in the optical density of the second region 22 with respect to a change in the intervals of the images 22*a* in the first direction D1 in the second region 22.

In addition to the above, as described above, the first FIG. 25 and the second FIG. 26 are translational symmetric with each other in the present embodiment. For this reason, the pattern recorded in the first region 21 is similar to the pattern recorded in the second region 22, and hence the difference between the optical density in the first region 21 and the optical density in the second region 22 in each unit pattern 20 is visually easily recognizable by the user.

In addition to the above, in the present embodiment, the unit patterns 20 are recorded on the sheet P by causing, among the ejection opening arrays 30*x*, two ejection opening arrays 30*x* which are the most distant from each other in the third direction D3 (i.e., the ejection opening array 30*x* corresponding to black and the ejection opening array 30*x* corresponding to magenta) to eject ink droplets. As such, by using two ejection opening arrays 30*x* which are the most distant from each other in the third direction D3, it is possible to increase the amount of change in the interval between the third position P3 and the fourth position P4 in the fourth direction D4 in response to the amount of change in the tilt angle of the head unit 3*x* with respect to the first direction D1, with the result that the amount of change in the optical density of the first region 21 is increased. This makes it possible to precisely calculate the tilt angle of the head unit 3*x* with respect to the first direction D1.

The positional adjustment of the head unit may be performed not only for adjusting the position of the head unit with respect to the other head units when there are plural head units but also for adjusting the position of the head unit with respect to components other than the head units in the liquid ejection apparatus (e.g., a cap for covering the opposing face).

The positional adjustment of the head unit may be performed not only during manufacture of the liquid ejection apparatus but also by the user of the liquid ejection apparatus. For example, the positional adjustment may be done when the user replaces a broken head unit by himself/herself.

The selection of the unit pattern in which the optical densities of the second regions are closest to the optical density of the first region from the unit patterns is not necessarily done by means of reading by a reader such as a scanner. For example, the selection may be done by means of visual observation by the user. In such a case, the unit pattern that the user selects by using the touch panel may be input to the controller, and the controller may automatically adjust the tilt angle of the head unit based on the input result.

In the above embodiment, an operation quantity of the adjuster (the first cam 31 and the second cam 32) is determined by using an approximation equation; however, the present invention is not limited to this. For example, the operation quantity of the adjuster may be determined by using an exact formula, or by using a table indicating an operation quantity of the adjuster and associated amount of travelling of the head unit.

Although the first position and the second position are each set to the center of an ejection opening in the above-mentioned embodiment, these positions may be set to any given position other than the center of an ejection opening. In this case, a marking or the like for positioning may be given to the position.

The first adjuster and the second adjuster may be structured by a member other than a cam (e.g. screw).

The head units do not have to be necessarily arranged in a zigzag manner, and may be arranged in one line or in two or more lines in a non-zigzag manner. Further, the direction of arranging the head units is not limited to the main scanning direction.

The above embodiment deals with a case where the liquid ejected from the ejection openings formed on the opposing face includes a plurality of kinds of liquids (e.g., ink of different colors such as black, yellow, and the like); however, the liquid to be ejected may be only a single kind of liquid (e.g. only black ink, only yellow ink, or the like). Further, the liquid is not limited to an ink, and may be any given liquid (e.g., a pretreatment liquid).

The energy applier is not limited to piezoelectric type adopting a piezoelectric element, and other type of energy applier may be adoptable (a thermal type adopting a heater element, an electrostatic type utilizing electrostatic force).

A liquid ejection apparatus related to the present invention is not limited to an inkjet type, and may be a laser type, a thermal transfer type, and the like. The liquid ejection apparatus of the present invention is not limited to a printer, and may be a facsimile, a photocopier, and the like.

The recording medium is not limited to a paper sheet. For example, in an intermediate transfer type, the recording medium is an intermediate transfer member (roller, belt, and the like).

The number of the unit patterns in the pattern group is not limited as long as the number is more than one.

Figure 12:
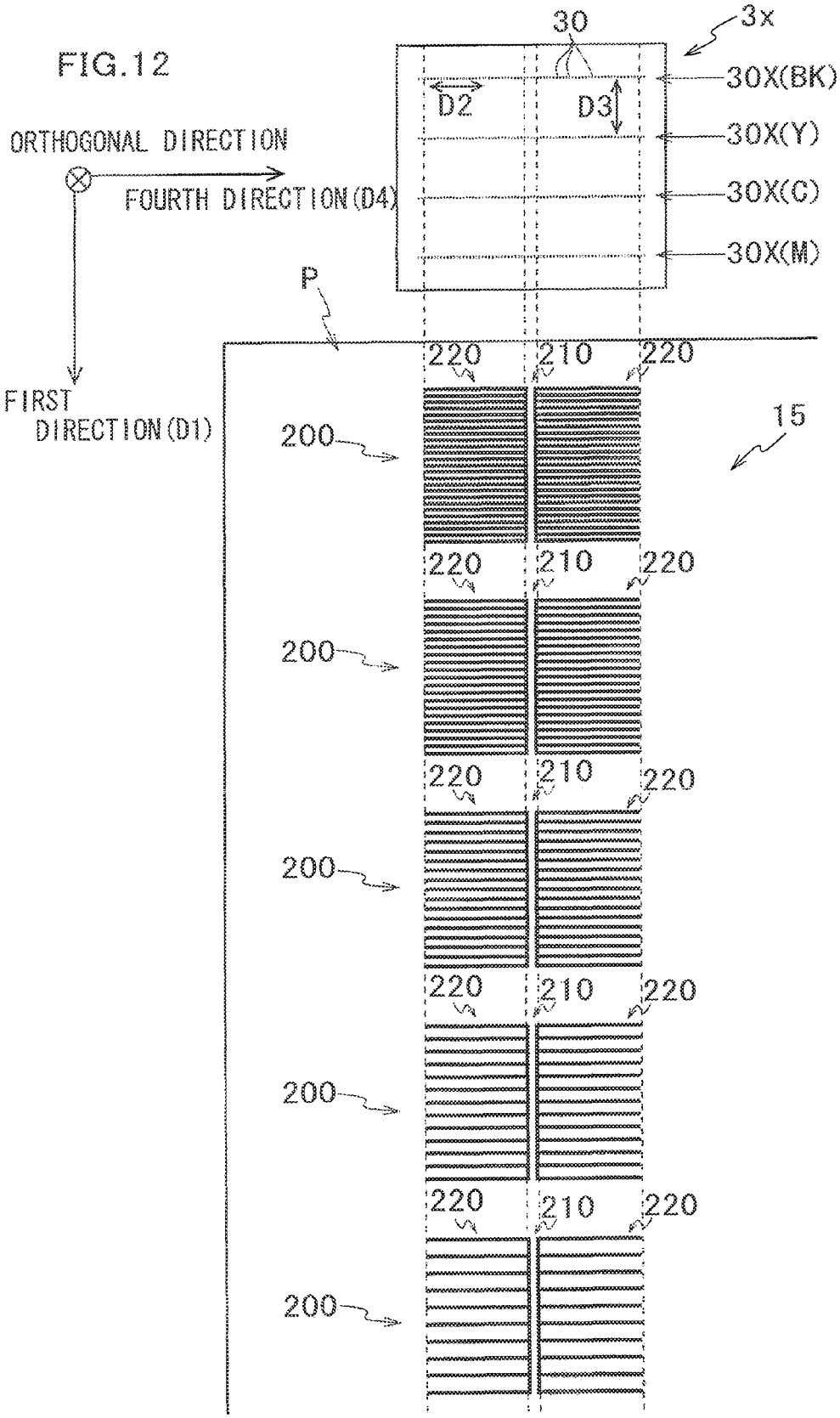
FIG. 12 shows pattern groups according to a variation.

In addition to the above, not limited to the embodiment above, the dot allocation of the first region of the unit pattern may be variously arranged on condition that the optical density varies in accordance with the intervals in the fourth direction of the dots formed on the sheet by impacted ink droplets, and the dot allocation of the second region may be variously arranged on condition that the optical density varies in accordance with the intervals in the first direction of the dots formed by impacted ink droplets on the sheet P. For example, the dot allocation of a first region 210 is arranged such that first figures each of which is rectangular and long in the first direction D1 are arranged to form two arrays in the fourth direction D4. Furthermore, the dot allocation of a second region 220 is arranged such that second figures each of which is 90-degree rotationally symmetric with the first figure are provided in the fourth direction D4. The dot allocations of the second regions 220 of unit patterns 200 are arranged to be different from one another in the intervals of the second figures in the fourth direction D4. When the first regions 210 and the second regions 220 of the unit patterns 200 are recorded with such dot allocations, as shown in FIG. 12, the correspondence relation between the dot intervals in the first region 210 in the fourth direction D4 and the optical density of the first region 21 is identical with the correspondence relation between the dot intervals in the second region 220 in the first direction D1 and the optical densities of the second regions 22 as in the embodiment above. In this regard, the length of the first FIG. 25 in the first direction D1 may not be identical with the length of the second FIG. 26 in the fourth direction D4.

While in the embodiment above the second regions are adjacent to the first region in the fourth direction in the unit pattern, the second regions may be separated from the first region. Furthermore, while in the embodiment above each unit pattern has two second regions, each unit pattern may have only one second region.

While the dot allocation of the first region is arranged so that the first figures form two arrays in the fourth direction, the dot allocation may be arranged so that the first figures form three or more arrays in the fourth direction.

In the tilt angle detection operation, while in the embodiment above grayscale conversion is performed for the image read by the scanner in order to reduce the difference between the optical density of the impacted region where black ink droplets impact and the optical density of the impacted region where magenta ink droplets impact, the disclosure is not limited to this arrangement. For example, when the scanner performs reading, the image is read in grayscale by applying light with the complementary color of magenta (i.e., green) by a lamp or the like onto the sheet on which the unit patterns are recorded. Alternatively, the color of the sheet on which the unit patterns are recorded may be changed to the complementary color of magenta. In this case, it is possible to reduce the difference between the optical density of the impacted region where black ink droplets impact and the optical density of the impacted region where magenta ink droplets impact, without performing the grayscale conversion above. Alternatively, the above-described process of reducing the difference between the optical densities may not be performed at all. Even if the optical density of the region where black ink droplets impact is different from the optical density of the region where magenta ink droplets impact, it is possible to directly compare the optical density of the first region with the optical densities of the second regions in the same manner as above, when the ratio of black dots to magenta dots in the first region is identical with the ratio of black dots to magenta dots in the two second regions in total.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a conveyor configured to convey a recording medium in a first direction;

a liquid ejection head in which ejection opening arrays, in each of which ejection openings for ejecting liquid are lined up in a second direction intersecting with the first direction, are lined up in a third direction orthogonal to the second direction; and a controller configured to control the conveyor and the liquid ejection head to record, onto the recording medium, a pattern group including unit patterns for detecting a tilt angle in the second direction with respect to the first direction, each of the unit patterns including:

a first region which is recorded on the recording medium by liquid ejected from the ejection openings of both a first ejection opening array and a second ejection opening array of the ejection opening arrays; and at least one second region which is recorded on the recording medium by liquid ejected from the ejection openings of one of the first ejection opening array and the second ejection opening array, the first region being a region recorded based on dot allocation with which an optical characteristic varies in accordance with intervals of dots formed by the impacted liquid in a fourth direction which is orthogonal to the first direction, the at least one second region being a region recorded based on dot allocation with which the optical characteristic varies in accordance with intervals of the dots formed by the impacted liquid in the first direction, and between the unit patterns of the pattern group, the first regions being identical with one another in the dot allocation, and the second regions being different from one another in the dot allocation.

2. The liquid ejection apparatus according to claim 1, wherein, the at least one second region of each of the unit patterns is adjacent to the first region in the fourth direction.

3. The liquid ejection apparatus according to claim 1, wherein, the number of the at least one second region in each of the unit patterns is two, and the two second regions correspond to the first ejection opening array and the second ejection opening array, respectively.

4. The liquid ejection apparatus according to claim 1, wherein, in the dot allocation of the first region, first figures are lined up in the fourth direction, and in the dot allocation of the at least one second region, second figures are lined up in the first direction.

5. The liquid ejection apparatus according to claim 4, wherein, each of the first figures and each of the second figures are 90-degree rotational symmetric with each other.

6. The liquid ejection apparatus according to claim 5, wherein, each of the first figures and each of the second figures are translational symmetric with each other.

7. The liquid ejection apparatus according to claim 4, wherein, each of the first figures and the second figures has an outline which forms a predetermined angle which is neither 0 degree nor 90 degrees with the first direction.

8. The liquid ejection apparatus according to claim 4, wherein, the optical characteristics of the second regions of the unit patterns are different from one another as an image recorded in each of the second patterns is different between the unit patterns, in intervals of the second figures in the first direction.

9. The liquid ejection apparatus according to claim 4, wherein, in the dot allocation of the first region, the first figures are lined up in the first direction and in the fourth direction, in the dot allocation of the at least one second region, the second figures are lined up in the first direction and in the fourth direction, and each of the first figures and the second figures has a diamond shape with a side forming an angle of 45 degrees with the first direction.

10. The liquid ejection apparatus according to claim 1, wherein, the first ejection opening array and the second ejection opening array are two ejection opening arrays which are most distant from each other in the third direction, among the ejection opening arrays.

11. A pattern group recording method for a liquid ejection apparatus including a conveyor configured to convey a recording medium in a first direction and a liquid ejection head in which ejection opening arrays, in each of which ejection openings for ejecting liquid are lined up in a second direction intersecting with the first direction, are lined up in a third direction orthogonal to the second direction, by which method a pattern group including unit patterns for detecting a tilt angle in the second direction with respect to the first direction is recorded onto the recording medium, the method comprising the step of controlling the conveyor and the liquid ejection head to record, onto the recording medium, the pattern group including the unit patterns, each of the unit patterns including:

a first region which is recorded on the recording medium by liquid ejected from the ejection openings of both a first ejection opening array and a second ejection opening array of the ejection opening arrays; and at least one second region which is recorded on the recording medium by liquid ejected from the ejection openings of one of the first ejection opening array and the second ejection opening array, the first region being a region formed based on dot allocation with which an optical characteristic varies in accordance with intervals of dots formed by the impacted liquid in a fourth direction which is orthogonal to the first direction, the at least one second region being a region formed based on dot allocation with which the optical characteristic varies in accordance with intervals of the dots formed by the impacted liquid in the first direction, and between the unit patterns of the pattern group, the first regions being identical with one another in the dot allocation, and the second regions being different from one another in the dot allocation.

12. The method according to claim 1, wherein, the number of the at least one second region in each of the unit patterns is two, and the two second regions correspond to the first ejection opening array and the second ejection opening array, respectively.

13. A tilt angle detection method comprising the steps of:

(i) selecting, from the unit patterns of the pattern group recorded onto the recording medium based on the method according to claim 11, a unit pattern in which the optical characteristic of the at least one second region is closest to the optical characteristic of the first region; and (ii) calculating the tilt angle in the second direction with respect to the first direction, based on the optical characteristic of the unit pattern selected in the step (i).

14. The method according to claim 13, further comprising the step of:

when the liquid ejected from the ejection openings of the first ejection opening array is different in color from the liquid ejected from the ejection openings of the second ejection opening array, before the step (i), converting the optical characteristics of the first region and the at least one second region by converting color information of dots impacted on the first region and the at least one second region, which are formed by the liquid ejected from the ejection openings of one of the first ejection opening array and the second ejection opening array, into color information of the liquid ejected from the ejection openings of the other one of the first ejection opening array and the second ejection opening array.

15. A non-transitory computer readable medium storing a program executed by a liquid ejection apparatus including a conveyor configured to convey a recording medium in a first direction and a liquid ejection head in which ejection opening arrays, in each of which ejection openings for ejecting liquid are lined up in a second direction intersecting with the first direction, are lined up in a third direction orthogonal to the second direction, the program causing the liquid ejection apparatus to execute the step of controlling the conveyor and the liquid ejection head to record, onto the recording medium, the pattern group including the unit patterns, each of the unit patterns including:

a first region which is recorded on the recording medium by liquid ejected from the ejection openings of both a first ejection opening array and a second ejection opening array of the ejection opening arrays; and at least one second region which is recorded on the recording medium by liquid ejected from the ejection openings of one of the first ejection opening array and the second ejection opening array, the first region being a region formed based on dot allocation with which an optical characteristic varies in accordance with intervals of dots formed by the impacted liquid in a fourth direction which is orthogonal to the first direction, the at least one second region being a region formed based on dot allocation with which the optical characteristic varies in accordance with intervals of the dots formed by the impacted liquid in the first direction, and between the unit patterns of the pattern group, the first regions being identical with one another in the dot allocation, and the second regions being different from one another in the dot allocation.

* * * * *